US009187996B1

(12) United States Patent
Nevison et al.

(10) Patent No.: US 9,187,996 B1
(45) Date of Patent: Nov. 17, 2015

(54) REDUCED EMISSIONS METHOD FOR RECOVERING PRODUCT FROM A HYDRAULIC FRACTURING OPERATION

(75) Inventors: Grant W. Nevison, Bragg Creek (CA); Robert Rodney Ross, Armstrong (CA)

(73) Assignee: MILLENNIUM STIMULATION SERVICES, LTD., Calgary, Alberta (CA)

( * ) Notice: Subject to any disclaimer, the term of this patent is extended or adjusted under 35 U.S.C. 154(b) by 0 days.

(21) Appl. No.: 14/418,390

(22) PCT Filed: Aug. 23, 2012

(86) PCT No.: PCT/CA2012/000798

§ 371 (c)(1),
(2), (4) Date: Aug. 10, 2015

(87) PCT Pub. No.: WO2014/029000

PCT Pub. Date: Feb. 27, 2014

(51) Int. Cl.
*E21B 43/34* (2006.01)
*E21B 43/26* (2006.01)

(52) U.S. Cl.
CPC ..... *E21B 43/34* (2013.01); *E21B 43/26* (2013.01)

(58) Field of Classification Search
CPC ..... E21B 43/26; E21B 43/34
See application file for complete search history.

(56) References Cited

U.S. PATENT DOCUMENTS

| | | | |
|---|---|---|---|
| 3,063,499 | A | 11/1962 | Allen |
| 3,137,344 | A | 6/1964 | Wiemar |
| 3,170,517 | A | 2/1965 | Graham et al. |
| 3,664,422 | A | 5/1972 | Bullen |
| 3,822,747 | A | 7/1974 | Maguire, Jr. |
| 4,326,969 | A | 4/1982 | Hunter |
| 4,417,989 | A | 11/1983 | Hunter |
| 5,653,287 | A | 8/1997 | Wilson et al. |
| 5,674,816 | A | 10/1997 | Loree |

(Continued)

FOREIGN PATENT DOCUMENTS

| | | |
|---|---|---|
| CA | 1047393 | 1/1979 |
| CA | 2538936 | 9/2007 |

(Continued)

OTHER PUBLICATIONS

Canadian Intellectual Property Office; International Preliminary Report on Patentability for PCT/CA2011/001112; Jun. 21, 2012; Gatineau, Quebec, CA.

(Continued)

*Primary Examiner* — Robert E Fuller
(74) *Attorney, Agent, or Firm* — Jeffrey L. Wendt; The Wendt Firm, P.C.

(57) ABSTRACT

A fracturing fluid mixture is used to hydraulically fracture underground formations in a reservoir, by mixing at least natural gas and a base fluid to form the fracturing fluid mixture, and injecting the fracturing fluid mixture into a well. Within the fracturing fluid mixture, the natural gas composition and content are selected such that a recovered gas component of a well stream is within the inlet specification of an existing gas processing facility, and the well stream has a wellhead flowing pressure that is sufficient to flow the well stream to surface, or have a flowing pressure that meets capture system inlet pressure requirements of the processing facility. The wellhead flowing pressure or the flowing pressure at the capture system inlet can be increased by adding natural gas to the fracturing fluid, which has the effect of reducing the bottom hole flowing pressure.

20 Claims, 10 Drawing Sheets

(56) References Cited

U.S. PATENT DOCUMENTS

| | | | |
|---|---|---|---|
| 6,302,209 | B1 | 10/2001 | Thompson, Sr. et al. |
| 2006/0065400 | A1 | 3/2006 | Smith |
| 2007/0204991 | A1 | 9/2007 | Loree et al. |
| 2008/0277115 | A1 | 11/2008 | Rediger et al. |
| 2009/0183874 | A1 | 7/2009 | Fordyce et al. |
| 2009/0301719 | A1 | 12/2009 | Bull et al. |
| 2010/0044049 | A1 | 2/2010 | Leshchyshyyn et al. |
| 2012/0012309 | A1 | 1/2012 | Noles, Jr. |

FOREIGN PATENT DOCUMENTS

| | | | |
|---|---|---|---|
| CA | 2644027 | | 9/2007 |
| CA | 2721488 | A1 | 12/2009 |
| CA | 2639539 | A1 | 3/2010 |
| CA | 2649203 | A1 | 6/2010 |
| WO | WO 2007/098606 | A1 | 9/2007 |
| WO | WO2010/025540 | A1 | 3/2010 |
| WO | WO2010/130037 | A1 | 11/2010 |
| WO | WO2011/000089 | A1 | 1/2011 |
| WO | WO2011/150486 | A1 | 12/2011 |
| WO | WO2012/097424 | A1 | 7/2012 |
| WO | WO2012/097425 | A1 | 7/2012 |
| WO | WO2012/097426 | A1 | 7/2012 |

OTHER PUBLICATIONS

Canadian Intellectual Property Office; International Preliminary Report on Patentability for PCT/CA2011/001113; Jun. 21, 2012; Gatineau, Quebec, CA.

Canadian Intellectual Property Office; International Preliminary Report on Patentability for PCT/CA2011/001114; Jun. 21, 2012; Gatineau, Quebec, CA.

Canadian Intellectual Property Office; International Search Report & Written Opinion for PCT/CA2011/001114; Jan. 6, 2012; Gatineau, Quebec, CA.

Canadian Intellectual Property Office; International Search Report & Written Opinion for PCT/CA2011/001113; Jan. 10, 2012; Gatineau, Quebec, CA.

Canadian Intellectual Property Office; International Search Report & Written Opinion for PCT/CA2011/001112; Jan. 11, 2012; Gatineau, Quebec, CA.

United States Patent & Trademark Office; Non-Final Office Action for U.S. Appl. No. 13/979,808 issued Dec. 4, 2014; Alexandria, VA; US.

United States Patent and Trademark Office; Non-Final Office Action for U.S. Appl. No. 13/979,823 issued Nov. 28, 2014; Alexandria, VA; US.

United States Patent and Trademark Office; Non-Final Office Action for U.S. Appl. No. 13/979,816 issued Nov. 24, 2014; Alexandria, VA; US.

Canadian Intellectual Property Office; International Search Report and Written Opinion for PCT/CA2012/000798; May 24, 2013; Gatineau, Quebec, CA.

Enfrac, Inc.; Response to Written Opinion Amendment Under Article 34 of the PCT; Mar. 28, 2014; Vancouver, BC; CA.

Canadian Intellectual Property Office; International Preliminary Report on Patentability—Chapter II for PCT/CA2012/000798; Dec. 9, 2014; Gatineau, Quebec; CA.

United States Patent and Trademark Office; Non-Final Office Action for U.S. Appl. No. 13/979,823 issued Feb. 4, 2015; Alexandria, VA; US.

REDUCED EMISSIONS METHOD FOR RECOVERING PRODUCT FROM A HYDRAULIC FRACTURING OPERATION

FIELD

This invention relates generally to a reduced emissions method for hydraulically fracturing a formation in an underground reservoir using a fracturing fluid mixture and recovering product from the reservoir.

BACKGROUND

When employing hydraulic fracturing to fracture a hydrocarbon formation in an underground reservoir, large quantities of liquids and proppant materials are injected into the reservoir. At the end of the fracturing treatment, the fracture system and reservoir are completely saturated with the fracturing fluid. To be produced, oil and gas must either flow around or through the fracture fluid saturated rock and fracture system such that the fracture fluid must be sufficiently removed from the pathway in order to not impair flow. To remove the fracturing fluids from the reservoir and fractures, a pressure differential is induced within the wellbore to draw the fracturing fluids out of the reservoir and fractures. In this manner the fracturing fluids are removed, or flowed back until sustained, stable and sufficient oil and gas production is achieved.

Once the well is placed on production, the flow of native reservoir fluids is directed from the well to a processing facility where the produced fluids are processed to a suitable specification for sales or reuse in some manner. Processing at the processing facility for natural gas may include liquids separation, dehydration, natural gas liquids capture, compression, plus contaminates removal for components such as carbon dioxide, nitrogen, sulfur, hydrogen sulfide and oxygen. The processing facility can be located in the vicinity of the wellbore or a remote location and fluidly coupled to the wellbore by a pipeline. Further, the processing facility may be applied to process native reservoir fluids from a single well, or multiple wells.

The processing facility is typically configured with the capacity and capability to process a fluid composition of primarily native reservoir fluids and at a prescribed inlet pressure, but this configuration is typically not suitable for processing a composition that includes well effluent such as fracturing fluids or the inlet pressures available during fracture fluids recovery. Most commonly, due to capacity and capability limitations of processing facilities, recovery of the injected fracturing fluids is accomplished by simply opening the well to atmosphere. Common to post-fracturing recovery, the water and proppant components of the effluent are separated from the gas component by temporary fracturing flow back equipment primarily comprised of a choke to control pressure, phase separation for solids, liquids and gases, storage and or processing for the liquids and a vent or flare to atmosphere as an outlet for the gas stream. The flow back equipment is often comprised of an open-ended conduit directing flow to a pit where the liquids and solids are separated and captured within the pit while gases are vented or burned to atmosphere. This technique maximizes the pressure differential induced within the wellbore to draw the fracturing fluids out of the reservoir plus eliminates the complexities, costs, upsets and damage that may be encountered by attempting to direct the post-fracture well stream to the production facilities.

For example consider a well which produces at least natural gas and has had nitrogen energized water based fracturing treatment completed. The processing facility has been configured to process the native well stream, which generally contains at least natural gas with 25 lb/MMscf water, 7 vol % carbon dioxide, 1 vol % nitrogen, 0 vol % sulfur, hydrogen sulfide and oxygen and with a heating content of 1025 Btu/ft3, all of which is to enter the processing facility at a minimum pressure of 75 psig. The processing facility is then configured to process this native gas to a sales specification with a target composition and condition not exceeding 7 lb/MMscf for water, 2-3 vol % for carbon dioxide, 3 vol % for nitrogen, 50 mg/m3 of sulfur, 15 mg/m3 of hydrogen sulfide and 0.4 vol % of oxygen with a heating value in the range of 950 to 1150 Btu/ft3 at an outlet pressure of 600 psi. As such, the processing facility is configured with capacity to remove at least 20 lb/MMscf water, through a dehydration process, and 5 vol % carbon dioxide, through an amine carbon dioxide capture system, from the native natural gas, and then compress the natural gas to the required outlet pressure of 600 psig. The facility will not be configured to remove nitrogen, sulfur, sulfur dioxide, or oxygen from the native gas, or to modify the heating content; as these components of the native natural gas are within sales specification. Following the fracturing treatment and during the flow back stage, the well is flowed to remove the fracturing fluids from the reservoir. This is completed using temporary fracturing flow back equipment until such time as sufficient native reservoir fluids are included within the well stream such that the well stream is within the capability of the processing facility to process to the sales specification. This is commonly referred to as the well being 'cleaned-up' where sufficient fracturing load fluid has been recovered and the well is placed 'on production'. This post-fracture clean-up process or flow back stage may take two or more weeks to complete which is a relatively short time in the life of the well and does not warrant alteration of the processing facility to permit processing the post-fracture well stream. Initially during flow back of the fracturing fluids, the well stream will be comprised of virtually 100% injected fracturing materials, such as water, proppant and nitrogen gas. This gas component of this initial well stream ("gas stream"), containing nitrogen content in excess of the capability of the processing facility cannot be directed to the facility and is, by necessity vented or flared until the content is at or below 3%. As an alternative to venting or flaring the high nitrogen content gas stream, the recovered gas stream can be processed for nitrogen removal prior to entering the processing facility inlet by adding, for example, a temporary nitrogen capture membrane system. This membrane system may by necessity include dehydration to remove excess water vapor within the gas, compression to drive the gas across the membrane, venting of the separated nitrogen to atmosphere and finally additional compression of the separated natural gas to meet the minimum inlet pressure of the processing facility.

Due to the large amount of liquids typically found in a post-fracturing well stream, the pressure of the gas stream may be insufficient to meet the inlet pressure requirement of the processing facility even though the content of the gas stream may be within composition specification. The excessive liquids contained within the flow back well stream, while flowing up the wellbore from the reservoir and to surface, exhibits higher flowing pressure losses. This causes a reduction in the flowing pressure to surface, often to below the inlet pressure requirement of the processing facility. Again, this necessitates venting or flaring of the gas stream until the water content is reduced such that pressure of the stream from the well is sufficient to overcome the minimum inlet pressure of the processing facility. As an alternative, should the gas composition be within the processing facility inlet specification while the pressure is too low to meet the inlet pressure requirement, a temporary gas compressor can be applied to sufficiently increase the pressure to meet the inlet pressure requirement to avoid venting or flaring. At least dehydration for water vapor removal prior to compression is likely needed in order for the gas component of the well stream to meet the compressor's inlet requirements.

Further, should the flowing pressure losses be such that the fluids will not readily flow to surface unassisted, load fluid recovery techniques can be deployed to move fluids to surface during the flow back stage. Two examples of such techniques are swabbing and gas-lifting. Both techniques tend to be costly, complex and time consuming and are add-on processes to the flow back operation following the fracturing treatment. Swabbing involves moving mechanical devices up the wellbore to cause liquids in the wellbore to be lifted to surface. Gas-lifting involves inserting a tubing string or coiled tubing inside the well casing to a specified depth then injecting gas such as nitrogen or natural gas into the tubing or annular space between the tubing and wellbore to cause liquids to move to surface. Gas-lifting can involve extensive surface equipment such as compressors to pressurize the gas, and dehydration and cooling equipment to treat the gas prior to compression.

While there are known techniques available for processing a well stream at surface and to pressurize the well stream to a sufficient processing facility inlet pressure, these techniques can be environmentally harmful, and include techniques like venting or flaring gases to atmosphere, and depositing liquids into open pits. These temporary techniques also tend to require complicated and expensive surface equipment, which also can introduce significant pressure losses, thereby compromising the pressure differential induced within the wellbore to draw the fracturing fluids out of the reservoir. Significantly reducing or eliminating venting, flaring and the water applied during hydraulic fracture completion operations is generally difficult, expensive, complex and ineffective, yet important to the environment and ultimate sustainability of existing well completion techniques. The oil and gas industry would benefit from an effective, cost efficient, and reduced emissions method to induce flow back behaviors after hydraulic fracturing.

SUMMARY

A fracturing fluid mixture is used to hydraulically fracture underground formations in a reservoir, by mixing at least natural gas and an aqueous or hydrocarbon-based fracturing base fluid to form the fracturing fluid mixture, and injecting the fracturing fluid mixture into a well. The well is fluidly coupled to the reservoir and to a surface processing facility. Within the fracturing fluid mixture, the natural gas composition and content are selected such that a recovered gas component of a well stream is within the inlet specification of the processing facility, and the well stream has a wellhead flowing pressure that is sufficient to flow the well stream to surface, or have a flowing pressure that meets capture system inlet pressure requirements of the processing facility. The wellhead flowing pressure or the flowing pressure at the capture system inlet can be increased by adding natural gas to the fracturing fluid, which has the effect of reducing the wellbore flowing pressure losses.

According to one aspect of the invention there is provided a method for hydraulically fracturing the formation in the reservoir using the fracturing fluid mixture and for recovering a well stream from the well that comprises the following steps:

(a) defining flow back requirements for flowing the well stream from the well and into the processing facility;

(b) determining a natural gas composition of the fracturing fluid mixture from the determined flow back requirements that results in a composition of a gas component of the well stream that is compatible with gas composition requirements of the processing facility;

(c) determining a natural gas content of the fracturing fluid mixture from the determined flow back requirements that results in a wellhead flowing pressure sufficient to flow the well stream at least to surface, or a well stream pressure at a capture system inlet that at least meets inlet pressure requirements of the processing facility.

(d) forming the fracturing fluid mixture having the selected natural gas composition;

(e) during a formation fracturing stage, injecting the fracturing fluid mixture into the well to fracture the formation; and (f) during a flow back stage, flowing the gas component of the well stream from the well into the processing facility, wherein at least some of the well stream includes the injected natural gas in the fracturing fluid mixture.

The well stream can also include native reservoir gases, in which case at least some of the native reservoir gases and injected natural gases are flowed into the processing facility. The well stream can also include native reservoir liquids in which case the method further can comprise separating a liquid component comprising the native reservoir liquids from the well stream using flow back equipment fluidly coupled between the well and the processing facility.

During the flow back stage, the gas component of the well stream can be flowed from the well into the processing facility without any venting or flaring, thereby eliminating or at least reducing harmful emissions released into the environment.

The processing facility can be configured to process gases and liquids in which case the method further comprises determining a natural gas composition of the fracturing fluid mixture from the determined flow back requirements that results in a composition of a gas component and a liquid component of the well stream that are compatible with gas and liquid composition requirements of the processing facility; and during the flow back stage, flowing the gas and liquid components of the well stream from the well into the processing facility, wherein at least some of the well stream includes the injected natural gas in the fracturing fluid mixture.

The flow back requirements can include pressure losses associated with flow back equipment fluidly coupled between the well and the processing facility. The flow back equipment can comprise a solids separator in which case the method further comprises separating solids from the well stream using the solids separator prior to flowing the gas and liquid components to the processing facility. Alternatively, the flow back equipment can comprise a gas-liquid flow separator in which case the method further comprises separating a gas component from the flow back fluids using the gas-liquid flow separator and then flowing the gas component to the processing facility. Alternatively, the flow back equipment can include a three-phase separator in which case the method further comprises using the three-phase separator to separate a gas component, a water component, and an oil component from the well stream. The separated gas component can be flowed to the processing facility, the water component can be flowed to a water treatment or disposal facility or to a water storage tank, and the oil component can be flowed to an oil processing facility, a sales facility, or an oil storage tank.

When the well stream at the capture system inlet is not at a pressure that meets the inlet pressure requirements of the processing facility, the method can further comprise compressing the gas component of the well stream using a compressor to a pressure that at least meets inlet pressure requirements of the processing facility. If necessary, condensing water can be recovered from the separated gas component using the flow back equipment until the gas component meets inlet requirements of the compressor. Also if necessary, condensing liquids can be removed from the gas component using a natural gas recovery or scrubbing unit to remove until the gas component meets inlet requirements of the compressor.

The flow back requirements can also include a maximum fracturing base fluid flow rate that results in a recovered fracturing base fluid volume that is within specifications of a water storage tank, in which case the method further comprises separating water from the well stream using surface flow back equipment fluidly coupled between the well and the processing facility, and storing the water in the water storage tank.

According to another aspect of the invention, there is provided a method for hydraulically fracturing a formation in a reservoir and for recovering a well stream from the well, comprising:

(a) defining flow back requirements for flowing the well stream from the well and into the processing facility;

(b) determining a natural gas content of the fracturing fluid mixture from the determined flow back requirements that results in a surface flowing pressure sufficient to flow the well stream to surface and which meets inlet pressure requirements of the processing facility;

(c) forming the fracturing fluid mixture having the selected natural gas content;

(d) during a formation fracturing stage, injecting the fracturing fluid mixture into the well to fracture the formation; and (e) during a flow back stage, flowing at least a gas component of the well stream from the well into the processing facility, wherein at least some of the well stream includes the injected natural gas in the fracturing fluid mixture.

The method can comprise determining a natural gas composition of the fracturing fluid mixture from the determined flow back requirements that results in a composition of the gas component of the well stream that is compatible with gas composition requirements of the processing facility. Alternatively, the method can further comprise processing the gas component of the well stream using surface flow back equipment fluidly coupled between the well and the processing facility until the composition of the gas component meets gas composition requirements of the processing facility.

DETAILED DESCRIPTION

Figure 1:
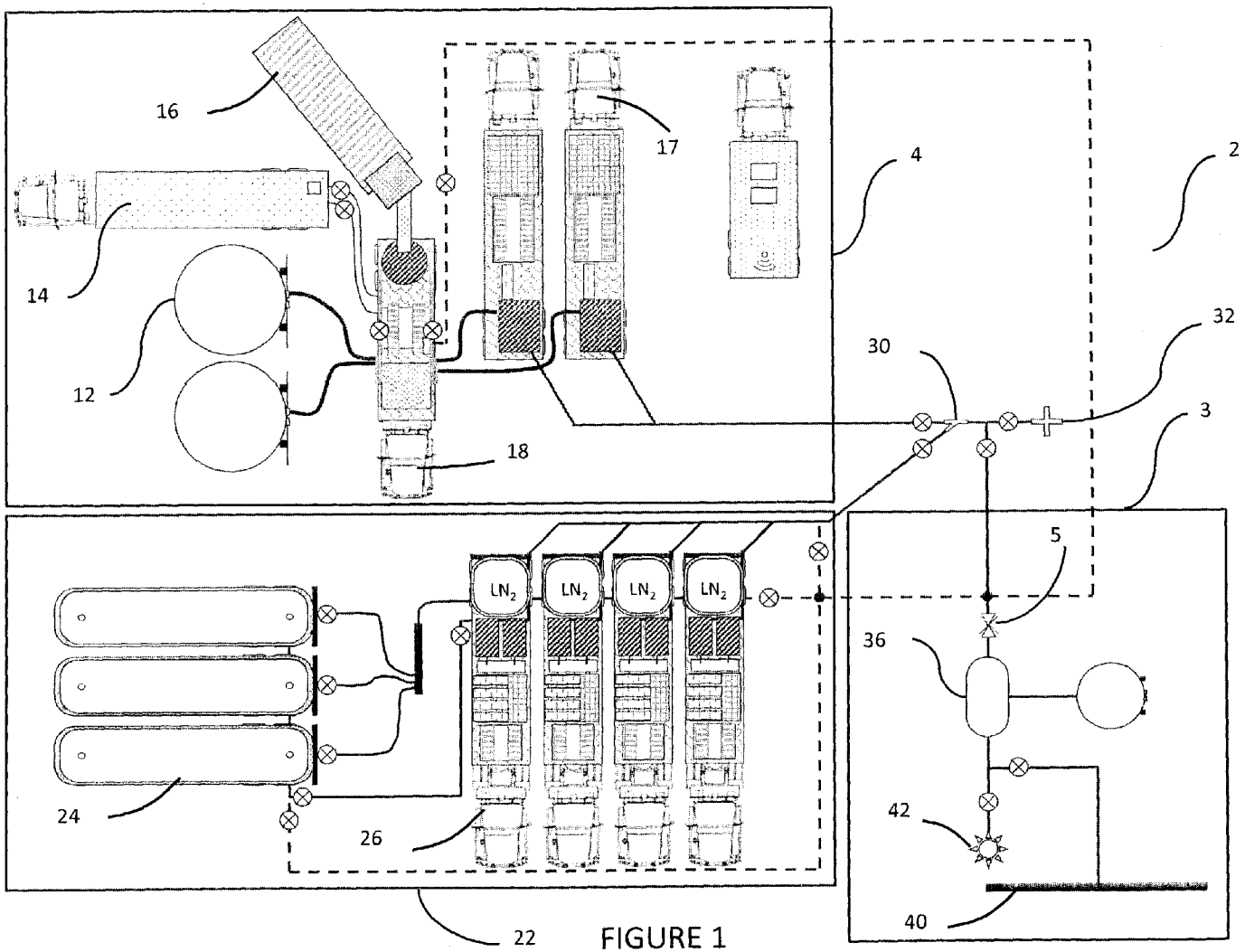
FIG. 1 is a schematic plan view of equipment for injecting a fracturing fluid mixture containing natural gas into a wellbore formation according to one embodiment of the invention.

In this description, various terms are used to describe the pressures at different locations in the reservoir and wellbore; these terms are ascribed a meaning as generally understood by one skilled in the art. The following provides a generalized summary of the relationships between these terms:

- Bottom hole flowing pressure (BHFP)=wellhead flowing pressure+wellbore hydrostatic pressure+wellbore flowing friction pressure;
- Wellhead flowing pressure (WHFP)=capture system entry pressure+surface equipment pressure losses;
- Capture system inlet pressure means the pressure at the inlet of a processing facility or a pipeline coupled to the processing facility;
- Surface equipment pressure losses mean the pressure losses of flow back fluids flowing through surface flow back equipment;
- BHFP=reservoir pressure−drawdown pressure
- Drawdown pressure=viscous flowing forces pressure loss+capillary forces pressure loss The embodiments described herein relate to a method for hydraulically fracturing a formation in a reservoir and capturing flow back fluids from the reservoir, that comprises selecting a natural gas content of a fracturing fluid mixture that will be sufficient to achieve a desired wellhead flowing pressure that is sufficient to flow a well stream to surface, or have a flowing pressure at a capture system inlet that meets pressure requirements of a processing facility. Furthermore, the composition of the natural gas is selected to provide a composition of the well stream that is compatible with composition requirements of the processing facility. The wellhead flowing pressure and flowing pressure at the capture system inlet can be increased by adding natural gas, which has the effect of reducing the flowing pressure losses within the wellbore.

The fracturing fluid mixture is used to hydraulically fracture underground formations in a reservoir, and involves mixing at least natural gas and a fracturing base fluid to form the fracturing fluid mixture then injecting the fracturing fluid mixture into a well that extends through the reservoir and to a formation to be fractured. The fracturing fluid mixture is then flowed back to surface from the reservoir along with native reservoir fluids and the well effluent gases (collectively "well stream") and then directed to a pipeline or processing facility.

The fracturing base fluid can comprise an aqueous or hydrocarbon well servicing fluid, as well as a proppant and one or more viscosifiers to impart viscosity to the mixture. The volume of natural gas added to the fracturing fluid mixture is manipulated so that the mixture has certain behaviors during the fracturing operation and subsequent fracturing fluids flow back operation. For the flow back operation these behaviors include a certain density, flowing characteristic and composition that achieves a particular flowing rate and surface pressure during flow back to permit capture of the well effluent gases to a pipeline or processing facility.

This fracturing base fluid is combined with a gaseous phase natural gas stream to form the fracturing fluid mixture. Dependent upon the nature of the fracturing base fluid, the natural gas component of the mixture can be marginally or highly miscible in the well servicing fluid. The resulting fracturing fluid mixture is injected into the underground formation to create fractures or to enhance existing fractures. As will be discussed in greater detail below, the quantity of the natural gas applied to the conventional hydrocarbon well servicing fluid is manipulated to create desired behaviors of the fracturing fluid mixture during the fracturing flow back operation, with the objective of improving performance of the fracturing flow back operation such that flow back fluids can be effectively and economically captured. More particularly, the quantity of natural gas can be manipulated to reduce the hydrostatic and flowing pressures in the wellbore, therefore decreasing the required bottom hole flowing pressure for a desired wellhead flowing pressure and flowing pressure at the capture system inlet. The quantity of natural gas can also be manipulated to reduce the liquid content of the base fluid when an aqueous or hydrocarbon base fluid is used in the fracturing fluid mixture, such that a manageable amount of the liquid can be captured in a tank or other closed system of the surface flow back equipment or which meets compositional requirements of a processing facility and thus can be flowed directly to the processing facility.

As used in this disclosure, natural gas means methane ($CH_4$) alone or blends of methane with other gases such as other gaseous hydrocarbons which may be present in commercial supplies of natural gas. Natural gas is often a variable mixture of about 85% to 99% methane ($CH_4$) and 1% to 15% ethane ($C_2H_6$), with further decreasing components of propane ($C_3H_8$), butane ($C_4H_{10}$) and pentane ($C_5H_{12}$) with traces of longer chain hydrocarbons. Natural gas, as used herein, may also contain inert gases such as carbon dioxide and nitrogen in varying degrees. Natural gas is in a gaseous state at standard conditions of 60° F. and 1 atmosphere with a critical temperature near −82° C. As will be described in greater detail below, the natural gas will be above its critical temperature throughout the fracturing formation operation and thus will be in a gaseous phase throughout the operation.

As used in this disclosure, the well servicing fluid serves as the fracturing base fluid in the fracturing fluid mixture and may mean any aqueous based or liquid hydrocarbon fluid. Aqueous based fluids may be comprised of water with brine, acid or methanol. Liquid hydrocarbon fluids are those containing alkanes and or aromatics that are applied to well servicing, stimulation or hydraulic fracturing.

Referring to FIG. 1, the embodiments described herein utilize formation fracturing equipment 2 to inject the fracturing fluid mixture into the reservoir. The embodiments can utilize flow back equipment 3 as shown in FIG. 1 to recover the flow back fluids, or optionally, the equipment shown in FIG. 4, 5 or 6.

More particularly, FIG. 1 illustrates one configuration of formation fracturing equipment 2 and flow back equipment 3 for applying and recovering a natural gas and well servicing fluid mixture in a closed system fracturing operation.

The formation fracturing equipment 2 includes the following well servicing preparing and pressurizing equipment 4: Frac liquid tanks 12 for containing the well servicing fluid fracturing base fluid), a chemical addition unit 14 for containing and applying viscosifying chemicals, and a proppant storage unit 16 for containing and applying proppant needed for the operation. The well servicing fluid, viscosifying chemicals, and proppant are combined within a fracturing blender 18 to form a prepared well servicing fluid then fed to base fluid fracturing pumpers 17 where the prepared well servicing fluid is pressured to fracturing conditions. The formation fracturing equipment 2 also includes the following natural gas preparation equipment 22: Mobile storage vessels 24 for storing natural gas in the form of liquefied natural gas (LNG). LNG fracturing pumpers 26 for pressurizing the LNG to fracturing conditions, and heating the LNG to a desired application temperature. The formation fracturing equipment 2 also includes components 30 for combining the prepared well servicing fluid with the gaseous natural gas stream to form the fracturing fluid mixture and subsequently directing this mixture to a wellhead 32. The combined fluids then travel down the wellbore and into the formation to fracture the interval.

The flow back equipment 3 as shown in FIG. 1 is for receiving and capturing the fracturing and produced reservoir fluids (well stream) that flow up the wellbore and out) of the wellhead 32 after completion of the fracturing treatment. In this embodiment, the well stream is directed from the wellhead 32, through a conduit coupled to the wellhead, past a choke 5, and to a gas-liquid flow separator 36. Pressure from the wellhead 32 and to the flow separator 36 is managed using the choke 5. Optionally, a sand or solids trap (not shown) may be placed downstream of the wellhead 32 and upstream of the choke 5 to prevent proppant or solids from flowing into the flow back equipment 3. Optionally, the flow back equipment 3 does not include the separator 36; instead, all of the well stream can be directed to a gas & liquids pipeline (not shown) for off-site processing provided that such well stream meets the compositional requirements of the pipeline and the processing facility coupled to the pipeline. If present, the gas-liquid flow separator 36 separates the recovered gas and liquid components of the well stream. The recovered liquid component includes the well servicing fluid and produced native reservoir liquids, and are directed to a liquids recovery tank 38. Instead of the liquids recovery tank 38, recovered liquids can be directed to a liquids pipeline (not shown) for processing should such processing facility exist. The recovered gas component, including the applied natural gas and produced native reservoir gases, is directed to a gas pipeline 40, where it is directed to a processing facility (not shown) for processing and sale. In this or a similar manner, an environmentally closed fracturing system can be created and applied permitting hydraulic fracturing and recovery without venting or flaring of gases by a vent/flare 42 and feeding liquids to an open pit.

Figure 2B:
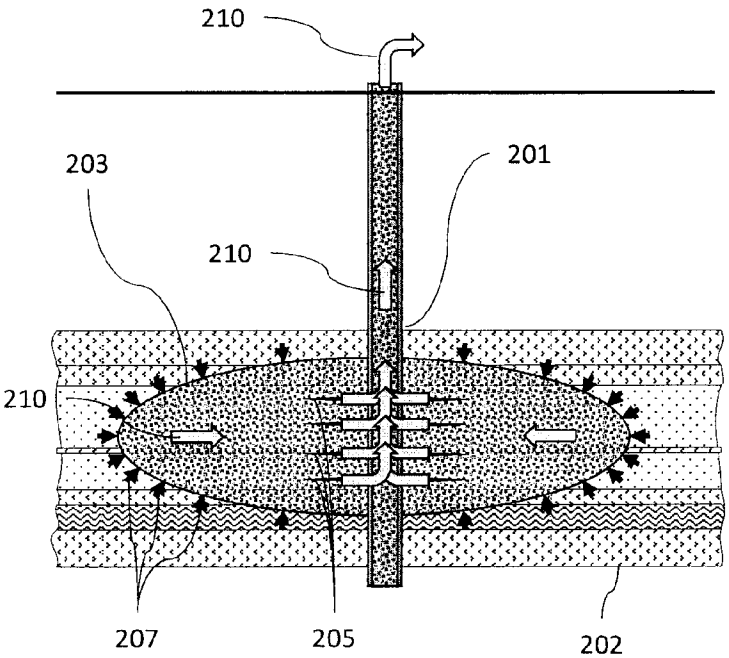
FIG. 2*a* and FIG. 2*b* shows an underground reservoir with fracture fluid injection into, and fracture fluid removal from, the underground reservoir.

The fracturing and flow back operations in accordance with one embodiment will now be described with reference to FIGS. 2*a* and 2*b* and FIG. 3.

Figure 2A:
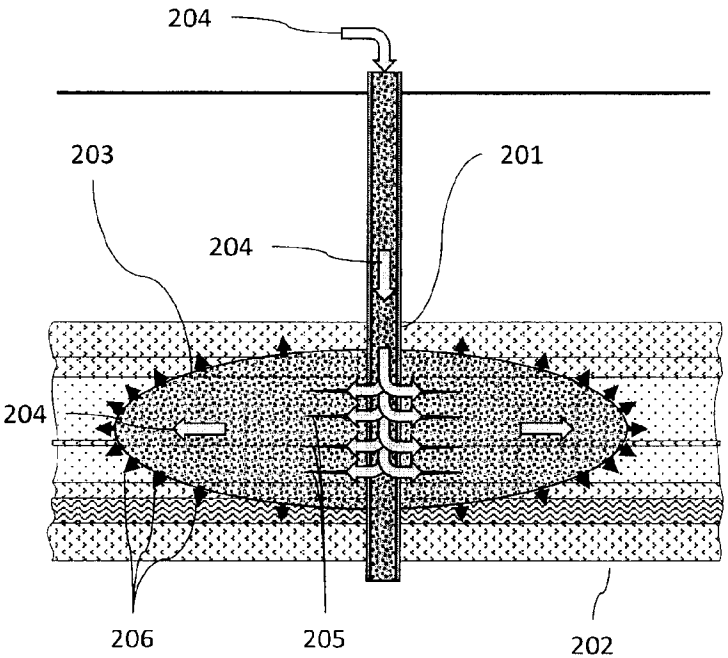

As shown in FIG. 2*a*, a fracturing fluid mixture 204 is injected into and down a wellbore 201 through perforations 205 and into an underground reservoir 202 to create single or multiple hydraulic fractures 203 radiating from the wellbore 201 and penetrating the reservoir 202 (while FIG. 2*a* depicts a symmetrical bi-wing fracture created in a vertical wellbore penetrating the underground reservoir, the same effect can apply to non-symmetrical multiple fractures created in either a vertical or horizontal wellbore). With injection for fracture creation, some or all of the fracturing fluid mixture 204 leaks from the fracture 203, referred to as "leak-off" 206, and into the reservoir 202, referred to as the 'invaded zone' within the reservoir 202. Upon creating sufficient hydraulic fractures, injection is stopped, the well is shut-in and the injected fracturing fluid mixture 204 dissipates into the underground reservoir 202 as equilibrium is approached or reached and the fractures 203 close on the proppant. The applied fracturing fluid mixture saturates the fractures and underground reservoir within the invaded zone following fracturing fluid injection.

In order to begin production of native reservoir fluids, the fracturing fluid mixture must be sufficiently removed from the fractures 203 and underground reservoir 202. The well is opened and as shown in FIG. 2*b*, a well stream 210 is often comprised of injected fracturing fluid and native reservoir fluid, and flows from the underground reservoir 202 through the fractures 203 and up the wellbore 201. If sufficient reservoir pressure exists to overcome the capillary and viscous flowing forces holding the fluids in place inside the reservoir (collectively "reservoir resistive effects"), as well as the bottom hole flowing pressure, the well stream 210 will flow from the reservoir 202 and fractures 203 up the wellbore 201, through any surface flow back equipment and into the processing facility (or into a pipeline for flow to a remotely located processing facility). As noted above, the bottom hole flowing pressure comprises frictional losses of the flow from the perforations to surface ("flowing friction pressure"), plus the hydrostatic pressure, plus any surface equipment pressure losses, and the capture system inlet pressure.

If the reservoir pressure cannot overcome the existing reservoir resistive effects and bottom hole flowing pressure, a certain amount of natural gas can be added to a fracturing fluid mixture to increase the wellhead flowing pressure such that the well stream 210 can overcome any surface flow back equipment pressure losses and still have a sufficient pressure at the capture system inlet to meet inlet pressure requirements for a pipeline or processing facility. More particularly, natural gas in the fracturing fluid serves to reduce the liquid content placed into the reservoir during the fracturing operation, lessen capillary and viscous flowing forces within the invaded zone and created fractures, and, by reduction of liquids in the returning flow stream, reduce the density and hence the hydrostatic pressure of the fluids flowing in the wellbore. The liquid content can be optionally reduced to a level which meets pipeline and processing facility compositional requirements, or at least to a level which can be captured by closed storage tanks, thereby avoiding the need to expose the liquids to the environment by depositing into an open pit.

Figure 3:
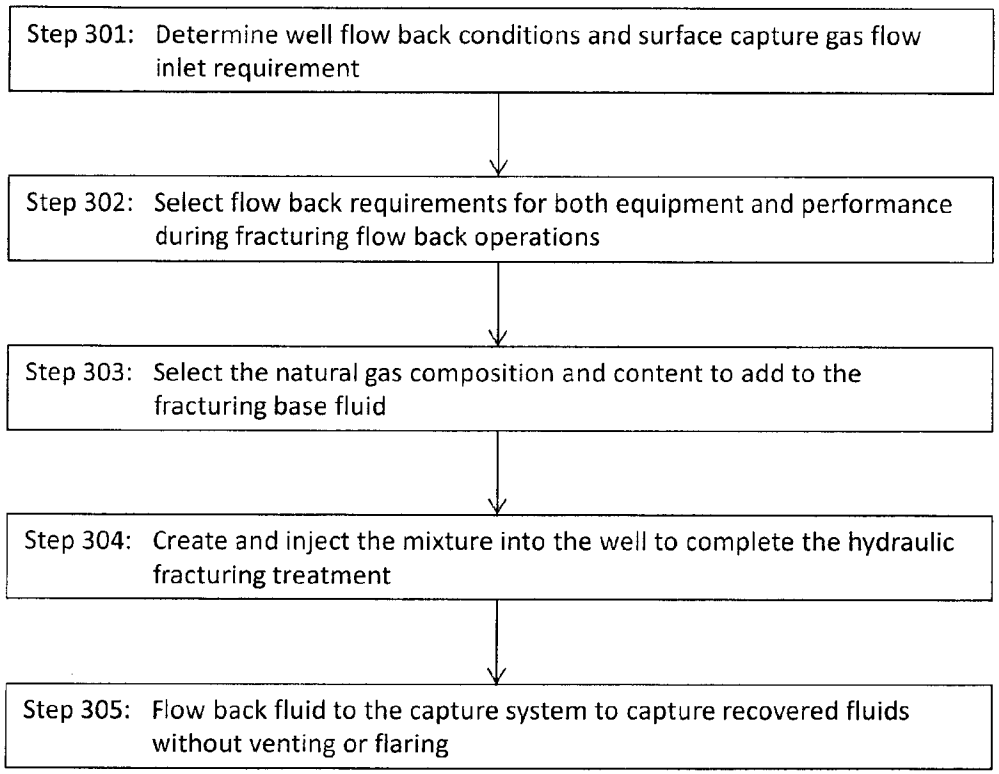
FIG. 3 is a flowchart illustrating the steps for a method of fracturing a formation using the fracturing fluid mixture and the equipment shown in FIG. 1, then flowing back the applied fracturing fluid mixture to capture the flow back effluent from the well.

FIG. 3 shows a series of steps carried out by a formation fracturing and flow back operation that are common to each embodiment. At step 301, well flow back and surface capture flow conditions are determined for a subject well and reservoir, which include:

- well properties including: the depth, temperature and pressure of the reservoir comprising the formation ("reservoir depth", "reservoir temperature" and "reservoir pressure");
- wellbore properties including casing outer diameter, surface roughness and wall thickness
- fracturing conditions including bottom hole fracturing pressure, and the fracturing base fluid characteristics including composition and density; and
- well flow back conditions including bottom hole flowing temperature and wellhead flowing temperature.

At step 302, flow back requirements for both equipment and performance are defined, and then certain properties of the fracturing fluid mixture 204 are determined that are required to achieve these defined requirements during the flow back operation. The flow back requirements include:

- equipment flow back requirements including: the processing facility inlet pressure requirement, pressure losses suffered by flow back fluids flowing through the flow back equipment 3 (which can be dictated by the flow back surface equipment configuration), and a target fluid entry pressure above the pipeline or processing facility inlet pressure requirement; and
- performance flow back requirements including: maximum water flow back rate, maximum gas flow back rate, target flow back pressure drawdown, target bottom hole drawdown (flowing) pressure, and the composition of the gases and/or liquids to be flowed into a pipeline or processing facility.

At step 303, the natural gas composition and content of the fracturing fluid mixture is determined that will achieve the defined flow back requirements during the fracturing flow back operation. This determination is achieved by defining a relationship between bottom hole flowing pressure and natural gas-to-base fluid ratio, using as inputs: the well flow back and surface capture flow conditions for the subject well and reservoir as well as the defined flow back requirements. Once this relationship has been determined, a natural gas-to-base fluid ratio is selected for a bottom hole flowing pressure that is below the reservoir pressure minus a drawdown pressure. Then the amount of natural gas and base fluid that needs to be mixed to form the fracturing fluid mixture that achieves this determined natural gas-to-base fluid ratio is determined. The composition of the injected natural gas is selected to ensure the flow back fluids, i.e. the combined flow of recovered injected gas, native reservoir gas and any fracturing induced contaminants meet or exceed pipeline specifications or the inlet requirements for the gas processing facility.

At step 304, the hydraulic fracture treatment is completed on the well in the reservoir 202 where the selected fracturing fluid mixture 204 is prepared and injected having the determined natural gas composition and content along with the base fluid.

At step 305, a well stream comprising the injected fracturing fluid mixture is flowed back from the reservoir 202 at the selected bottom hole flowing pressure and the selected flow rate such that the recovered well stream meet the flow back requirements and result in surface pressures that permit capture and processing of at least a recovered gas component of the well stream during the flow back operation.

When defining the flow back requirements per step 302, consideration can be given to the processing facility inlet pressure and compositional requirements. For example, a maximum gas flow rate can be dictated by the capacity and capability of the processing facility to process the flow back gases to meet or exceed the sales specification, and a maximum fracturing base fluid (e.g. water) flow rate and total base fluid recovered can be dictated by the ability for a closed captured system to capture and store water. By specifying flow back requirements that meet both the pipeline or processing facility pressure and compositional requirements, the amount of surface flow back equipment can be reduced, thereby potentially saving time and cost when compared to conventional processes that require treatment of the well stream prior to meeting compositional requirements and/or compression of flow back gases to meet pressure requirements. Further, by being able to flow the well stream directly to the processing facility, potentially environmentally adverse actions like venting and flaring can be reduced or avoided altogether.

In one embodiment, the composition requirements of the processing facility can be met by selecting a fracturing fluid mixture that comprises a natural gas composition which meets pipeline gas composition specification. In this embodiment, the base fluid can be water or a liquid hydrocarbon, which can be separated from the well stream by a gas-liquid separator in the surface flow back equipment. The remaining well stream thus contains the natural gas component of the fracturing fluid mixture, as well as native reservoir fluids. Since the processing facility is already configured to handle the composition of native reservoir fluids, and since the natural gas composition is selected to meet processing facility compositional requirements, the remaining well stream should be able to flow directly to the processing facility with only phase separation by the surface flow back equipment 3.

Figure 7:
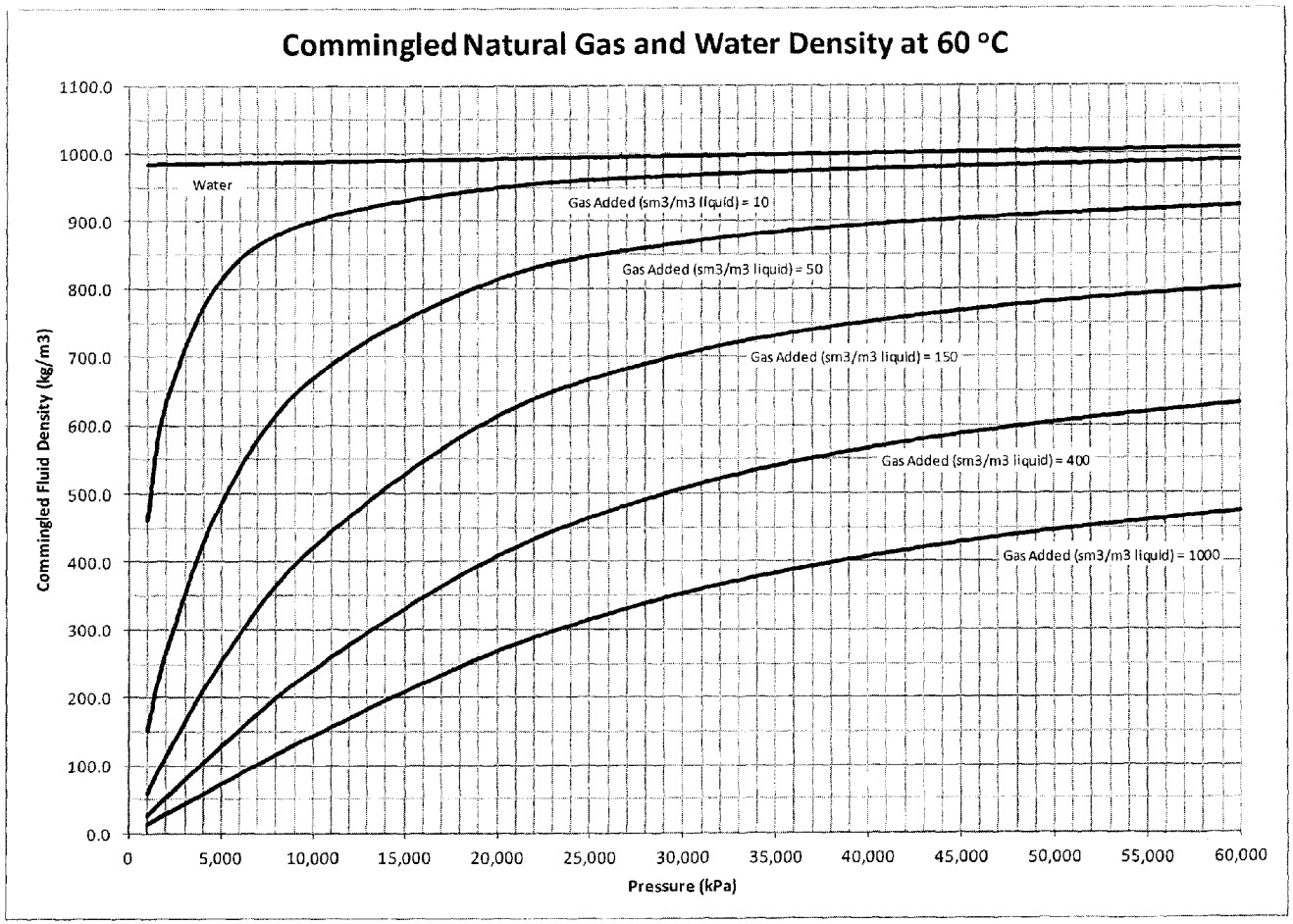
FIG. 7 is a diagram showing the reduction in commingled fluid density achieved by adding natural gas to water over a range of pressures at a temperature of 60° C.

Determining the natural gas content to achieve the defined flow back requirements per step 303 will now be discussed in more detail with reference to FIGS. 7 to 10. FIG. 7 illustrates a reduction in commingled fluid density that can be achieved by adding natural gas to water, e.g. when a fracture fluid mixture comprises natural gas and an aqueous base fluid. Commingled fluid density determines the hydrostatic pressure exerted at the underground reservoir by fluids contained within a wellbore. Comingled fluid density also determines the total amount of water that is likely to be applied and hence can be recovered during the flow back stage; the information can dictate the capacity of any storage tanks provided to store the water prior to disposal or further processing. In FIG. 7, a range of pressures from 1,000 kPa to 60,000 kPa at a temperature of 60° C. is presented as an illustration of density at selected natural gas and water ratios. The natural gas to water ratios range from no added gas to gas added at a ratio of 1,000 $sm^3$ of natural gas for each $m^3$ of water. Similar density reductions at other pressures, temperatures, gas ratios and aqueous based liquids can be achieved. As shown in FIG. 7, water has a relatively consistent density of approximately 1,000 $kg/m^3$ at temperature and pressure such that a hydrostatic gradient of approximately 9.8 kPa/m is exhibited. For a 2,000 m well, this results in a hydrostatic pressure of 19,600 kPa at the base of the wellbore. Wellbore flowing friction pressures create addition pressure loss and add to the total bottom hole flowing pressure such that flow back rates without sufficient reservoir pressure can be very low or nonexistent and extend the flow back period. If the bottom hole flowing pressure nearly matches the reservoir pressure, the pressure differential available to overcome reservoir resistive forces, i.e. viscous flowing forces, capillary pressures and relative permeability effects, is minimal and fluid removal from the fracture system and reservoir is compromised. In contrast, with a natural gas ratio of 400 $sm^3/m^3$ liquid, the density can vary from ~60 $kg/m^3$ at 1,000 kPa to 630 $kg/m^3$ at 60,000 kPa resulting in a density reduction from about 40% to 95% with a corresponding reduction in hydrostatic pressure exhibited by the fluid column on the underground reservoir. As a result, the bottom hole flowing pressure is reduced and the pressure differential with the reservoir pressure is increased.

Figure 8:
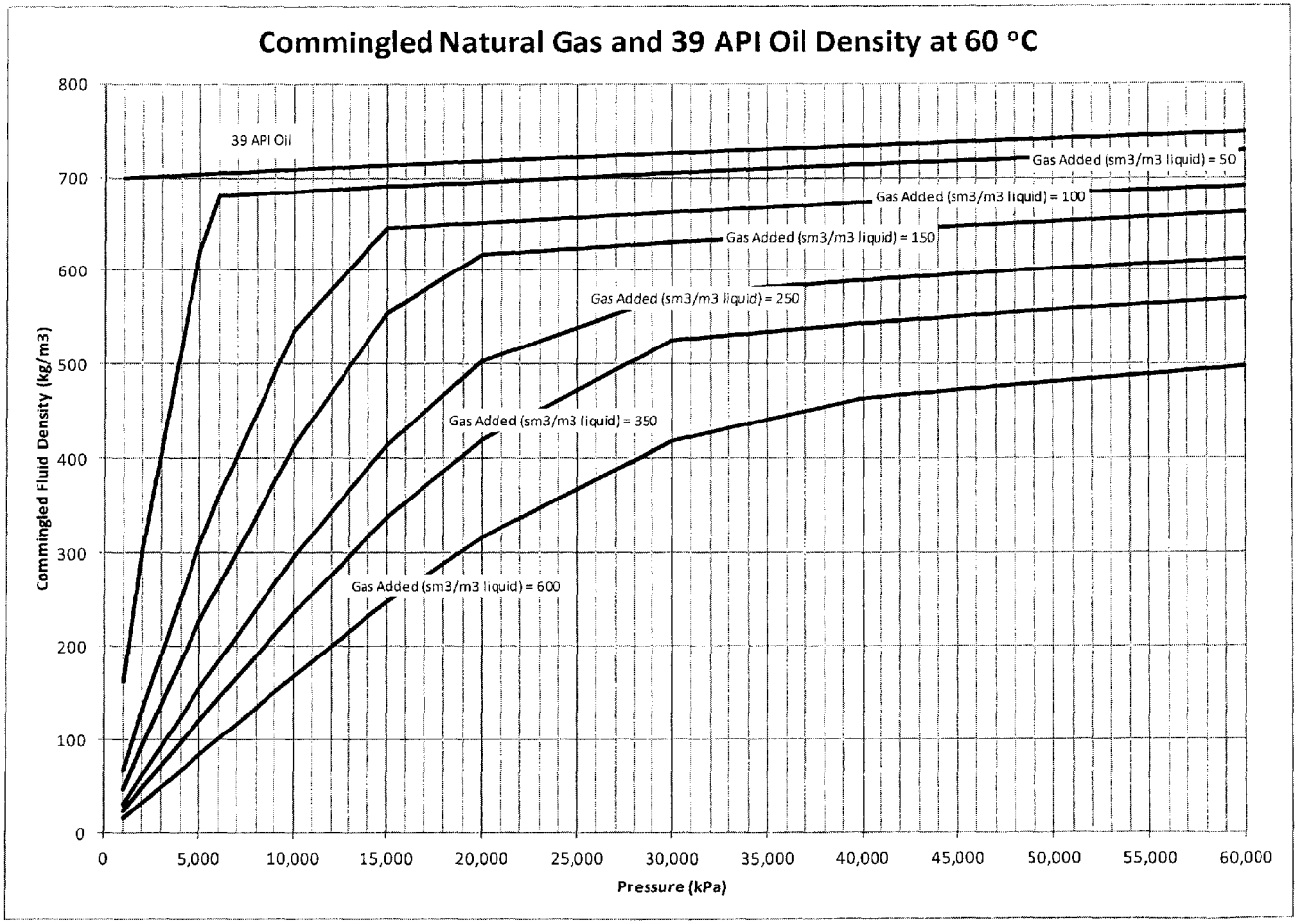
FIG. 8 is a diagram showing the reduction in commingled fluid density achieved by adding natural gas to a 39 API fracturing oil over a range of pressures at a temperature of 60° C.

FIG. 8, similar to FIG. 7 is a diagram provided for illustration of the reduction in commingled fluid density that can be achieved by adding natural gas to a hydrocarbon based well servicing fluid to form a fracturing fluid mixture. The effect differs from that with water in that the natural gas is highly soluble in the hydrocarbon based well servicing fluid. Due to the solubility all added gas may be dissolved within the hydrocarbon based well servicing fluid at higher pressures—the mixture is above the bubble point at the composition and corresponding pressure and temperature. This effect is illustrated on the figure by the linear increase of density for a given gas to liquid ratio with increasing pressure such as that seen at 50 $sm^3/m^3$ liquid beginning at approximately 6,000 kPa. With some hydrocarbon well servicing fluids at higher natural gas ratios, the behavior of the resulting mixture can be tailored to achieve a very low density super critical fluid mixture with no liquids, or a condensing mixture with only a very small fraction of liquids. Like FIG. 7, FIG. 8 can be used to calculate the total amount of hydrocarbon base fluid that is likely to be applied and can be recovered during the flow back stage, which can dictate the capacity of storage tanks used to store the base fluid prior to further processing.

Figure 9:
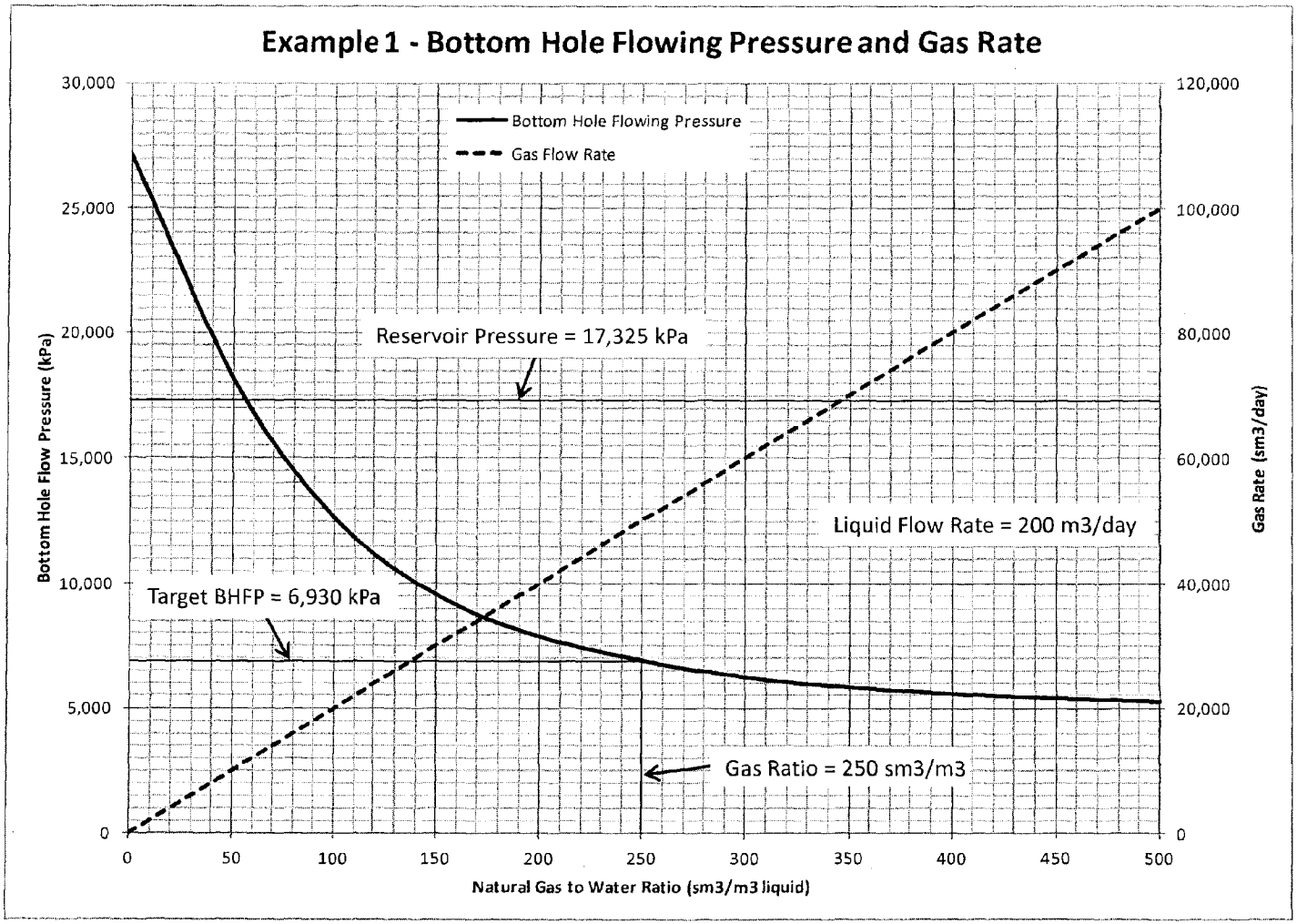
FIG. 9 is a diagram illustrating the bottom hole flow pressure resulting from a range of natural gas addition ratios to water for an example well flowing at a liquid rate of 200 $m^3$/day.

FIG. 9 is a graph of bottom hole flowing pressure and natural gas-to-water ratios at certain specified well flow back and surface capture flow conditions and at certain defined flow back requirements. FIG. 9 also graphs natural gas flowing rate and natural gas-to-water ratio under the same conditions. This graph was generated by a commercially available multiphase flow simulator program common in the industry, such as GLEWPro™, using the well flow back and surface capture conditions and flow back requirements as provided in Example 1 below.

Examination of FIG. 9 shows a curve indicating bottom hole pressures as high as 27,200 kPa when no gas is added to as low as 5,025 kPa with gas added at 500 $sm^3/m^3$ water. With no gas addition, it can be seen that the bottom hole fluid pressure far exceeds the reservoir pressure and flow back will not occur under these conditions. The natural gas content required to meet the defined flow back requirements per step 303 is determined by identifying in FIG. 9 the natural gas to water ratio required to lower the bottom hole flowing pressure to below a pressure that is the difference between the reservoir pressure and a drawdown pressure that overcomes the reservoir resistive effects at the desired recovery rate. In a manner as known in the art, a target flow back pressure drawdown percentage can be selected which is expected to be sufficient to overcome the predicted reservoir resistive effects. This selected drawdown percentage can be used to calculate the pressure drawdown. The bottom hole flowing pressure required to flow fluids to the processing facility can be determined by subtracting the drawdown pressure from the reservoir pressure. Once the required bottom hole flowing pressure is determined, the required natural gas-to-water ratio can be determined from FIG. 9, and a suitable fracturing fluid mixture (using water as the base fluid) having this ratio can be used to perform the fracturing operation.

As will be discussed in Example 1 below, the target drawdown percentage used in FIG. 9 is 60%, resulting in a target drawdown pressure of 10,395 kPa. The target bottom hole flow pressure is thus 6930 kPa, and the required natural gas-to-water ratio is thus 250 $sm^3/m^3$. At this target bottom hole flow pressure, the natural gas flow rate to surface is about 50,000 $sm^3$/day and the liquid flow rate to surface was defined in the flow back requirement as 200 $m^3$/day. Assuming the originally defined flow back requirements meet the pipeline and processing facility composition requirements, then it is expected that this gas flow rate and its composition are compatible with the processing facility specifications and that the well stream can be flowed directly to the processing facility (or via a pipeline) or with only phase separation of liquids if the processing facility is configured to process gas.

As noted above, the addition of natural gas reduces the bottom hole flowing pressure by reducing the hydrostatic pressure. However, the behavior of commingled fluids flowing within a wellbore is complex and does not readily lend itself to simple calculations and computer programs are utilized to compute the behaviors. In fact, the pressure will vary along the wellbore which compresses or expands the gas phase and alters the density which impacts the resulting hydrostatic. Similarly for flowing friction within the wellbore, the friction pressure losses of the commingled fluid vary with the relative volume of gas present where again the relative volume of gas present varies with pressure along the wellbore.

In addition to selecting the natural gas content in the fracturing fluid to cause the well stream to meet processing facility inlet pressure requirements, the natural gas composition is also selected to ensure the flow back fluids meet compositional requirements for flow into the processing facility. Manipulation of the methane content in the natural gas up to a purity approaching 100% can be considered to ensure the well stream meets compositional requirements. Alternatively, to target a requirement for a higher than normal heating value content in the return gases, the injected natural gas composition can be selected to contain only 85% methane with the ethane and propane content increased to increase the heating value. Similar manipulations to the content of other components can be completed to meet a wide range of flow back composition target requirements. For example, a fracturing induced contaminant may include carbon dioxide released from an acid based treatment completed on a carbonate formation. In this instance, the content of the natural gas in the fracturing fluid may be increased in order to dilute the carbon dioxide content of the fracturing fluid to meet the inlet requirements. Alternatively, stripping of light ends into the recovered gas stream from an oil based fracturing treatment during flow back may result in too high a heating value such that a injected gas methane content approaching 100%, or alternatively an increased nitrogen content is used to reduce the recovered gas heating value In the manner described above, applying a selected natural gas composition and content to fracturing fluids serves to permit flow back of the fracturing liquids and capture of the flow back gases into a pipeline or processing facility with no or minimal venting and flaring. The gas content is manipulated at least to ensure flow from the reservoir 202 and up the wellbore 201 with sufficient pressure at surface for phase separation, if needed, and for the recovered gas component of the well stream to enter the processing facility without compression. Further, the injected natural gas composition is manipulated to ensure the composition of the gas component of the well stream meets or exceeds the inlet requirements for the pipeline or processing facility. This can eliminate the requirement, complexity and the cost associated with inducing well stream flow by methods such as swabbing and gas-lift. It also eliminates the need to treat and compress the gas component prior to entry to the processing facility. Further, the composition of the gas component is managed to ensure the cost, complexity and complications of pre-processing for the removal of contaminants such as nitrogen and carbon dioxide are avoided. As discussed below, the flow back gases can be easily recovered without specialized surface flow back equipment or systems such as dehydrators, membrane gas separators, amine towers, refrigeration units, placement of an additional tubing string, injection for gas-lift, swabbing and compression of gases for re-injection or for inlet into processing facilities. In some applications the natural gas content added to the fracturing fluid may be restricted and all processing and flow back criteria may not be met. In those cases, application of natural gas in the fracturing fluid may serve to reduce the specialized surface equipment needed rather than eliminate it.

Figure 4:
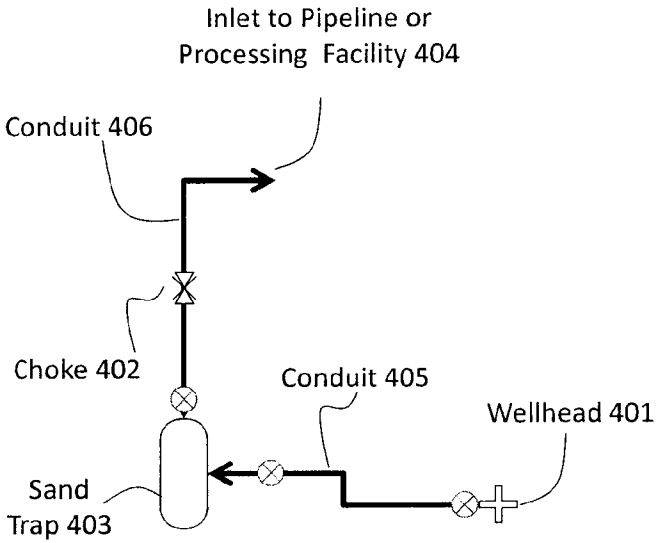
FIG. 4 is a diagram illustrating the main components of fracturing fluid flow back equipment according to an embodiment of a natural gas mixture fracture treatment for capture of fracturing and native gases to a processing facility.

According to another embodiment and referring to FIG. 4, the surface flow back equipment 3 is configured to provide complete recovery of the post-fracturing well stream, including the injected natural gas and native reservoir fluids, which is then directed to a processing facility 404 configured to process both liquids and gases. In this embodiment, an optional sand trap 403 is provided where solids such as proppants can be removed from the well stream prior to entry to the processing facility 404. The flowing pressure at a wellhead 401 must be sufficient to overcome pressure losses through a conduit 405, the sand trap 403, across a choke 402 and a conduit 406 at the flow back rate while maintaining sufficient pressure to meet the pressure requirement at the inlet to the processing facility 404. The natural gas content of the injected fracture fluid mixture is manipulated to ensure an adequate wellhead pressure exists at the desired flow back conditions. This configuration is particularly applicable to flow back to processing facilities capable of processing both liquids and gases such as is often found at oil producing wells, or liquids-rich gas wells.

Figure 5:
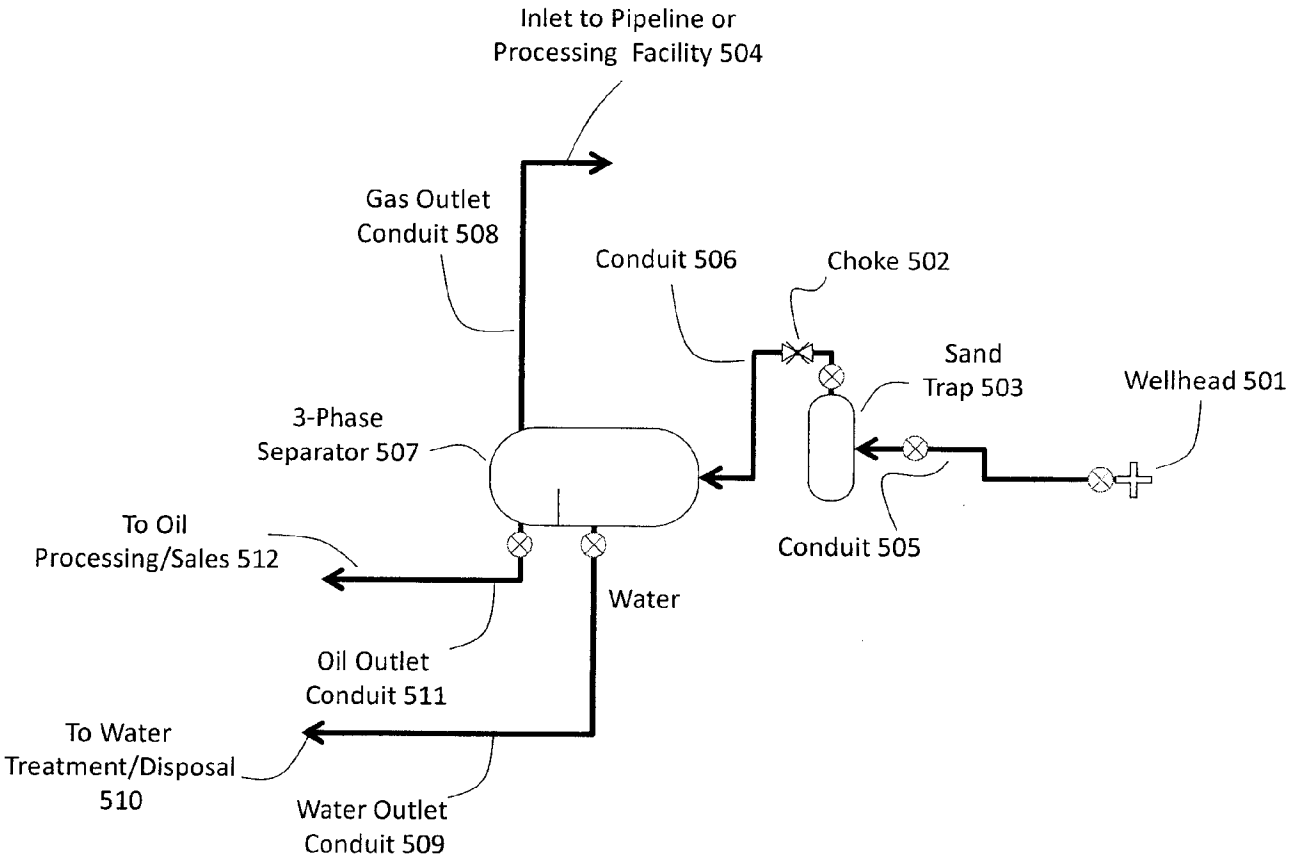
FIG. 5 is a diagram that illustrates the main components of fracturing fluid flow back equipment according to an embodiment of a natural gas mixture fracture treatment for separation of liquids from the flow back well stream with recovery of gases to a processing facility.

According to another embodiment and referring to FIG. 5, the surface flow back equipment 3 is configured to recover the post-fracturing well stream such that the well stream is separated into its phases for capture and only the gas component is directed to a gas pipeline or processing facility 504; the liquid component is directed to separate capture systems potentially comprised of at least storage, pipeline transport, processing, treatment or disposal. In this embodiment, the flow back equipment 3 shown in FIG. 4 is expanded to include a 3-phase separator 507 where the gas, water and oil components are separated into a gas component for flow through a gas conduit 508 to the gas pipeline/gas processing facility 504, a water component for flow through a water conduit 509 to a water treatment/disposal facility 510 and an oil component for flow through an oil conduit 511 to an oil processing/sales facility 512. Optionally, a 4-phase separator (not shown) can be applied in place of the 3-phase separator 507 where solids are also captured within the 4-phase separator and a sand trap 503 would thus not be required. Alternatively, if the well stream comprises only gas and water, a 2-phase separator (not shown) could be used in place of the 3-phase separator 507.

Alternatively, the water and oil components can be stored in respective temporary storage tanks (not shown) for transport by truck or other means to a disposal, processing or sales facility.

As noted above, recovered natural gas, comprised of injected natural gas and natural gas native to the reservoir ("native natural gas") are directed via the gas conduit 508 to the pipeline or processing facility inlet 504. The pipeline 504 may serve to transport natural gas to an off-site facility (not shown) for processing or sales or optionally be directed to an on-site capture facility such as, for example, processing and storage as compressed or liquefied natural gas. Separated liquid oil, including oil which may be used as the fracturing base fluid is directed via the oil conduit 511 to the oil processing/sales facility 512 which may be a pipeline or on-site oil processing facility or storage. Similarly, separated water is directed through the water conduit 509 to the water treatment/disposal facility 510. This water may be comprised of water injected for the fracturing treatment or native formation water and may be treated for re-use for hydraulic fracturing or other purpose, or disposed by injection in a disposal well (not shown). The flowing pressure at the wellhead 501 must be sufficient to overcome pressure losses across the components 502, 505, 503, 506 plus the pressure losses across the separator 507 and conduit 508 at the flow back rate while maintaining sufficient pressure to meet the pressure requirement at the inlet to pipeline or processing facility 504. Again, the natural gas content of the injected fracture fluid mixture is selected to ensure an adequate wellhead pressure exists at the desired flow back conditions.

The flow back equipment configuration in this embodiment is useful for flow back of hydraulic fracture treatments containing natural gas where a natural gas pipeline or capture system exists with little or no capacity for liquids in the processing facility. This is common at lean or dry gas wells or where the produced liquid content is low and liquids are separated and captured to storage on-site.

Figure 6:
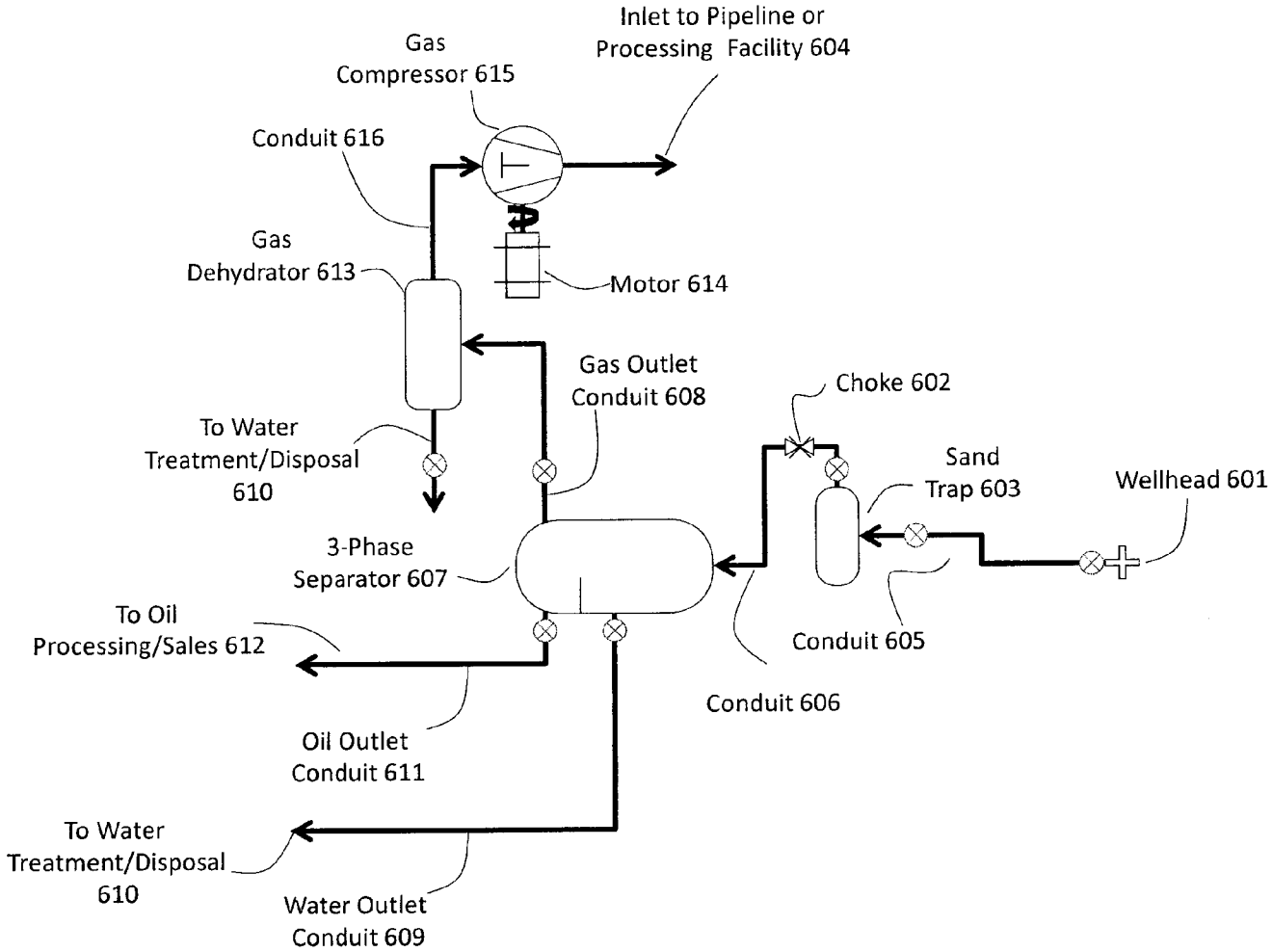
FIG. 6 is a diagram that illustrates the main components of fracturing fluid flow back equipment according to an embodiment of a natural gas mixture fracture treatment for separation of liquids from the flow back well stream with compression of gases prior to entry into a processing facility.

According to yet another embodiment and referring to FIG. 6, the surface flow back equipment 3 is configured to recover a post-fracturing well stream by separating the well stream into a gas component, a water component and a liquid oil component, and wherein the gas component does not have sufficient flow back pressure to meet processing facility requirements. Like the embodiment shown in FIG. 5, the flow back equipment includes a conduit 605 which fluidly couples a wellhead 601 to a sandtrap 603. Another conduit 606 with a choke 602 fluidly couples the sandtrap 603 to a 3-phase separator 607, which separate the well stream into a gas component for flow through a gas conduit 608 to a gas pipeline or gas processing facility 604, a water component for flow through a water conduit 609 to a water treatment or disposal facility 610, and a liquid oil component for flow through an oil conduit 611 to an oil processing or sales facility 612. In this embodiment, the flow back equipment 3 includes a gas dehydrator 613, a motor 614 and a gas compressor 615 all fluidly coupled to the gas conduit 608 provide sufficient pressurization of the recovered gas component to meet the pressure requirements at the inlet to the gas processing facility 604. The gas dehydrator 613 is deployed to recover condensing water from the gas stream to avoid damage to the compressor 615. In the case of liquids-rich gas production, the dehydrator 613 may be replaced or supplemented by a natural gas liquids recovery or scrubbing unit (not shown) to remove those condensing liquids from the gas component stream. The flowing pressure at the wellhead 601 must be sufficient to overcome pressure losses across the equipment 602, 605, 603, 606, 607, 608, the gas dehydrator 613, and the conduit 616 at the flow back rate while maintaining sufficient pressure to meet the inlet pressure requirement to compressor 615 driven by motor 614. Compressor 615 is operated to increase the pressure of the injected and native reservoir gases to meet the pressure requirement at the inlet to pipeline or capture system 604. Again, the natural gas content of the injected fracture fluid mixture is selected to ensure an adequate wellhead pressure exists at the desired flow back conditions. In this instance, the natural gas added to the fracturing fluid mixture serves to minimize the compressor 615 pressure load, for example where multiple stages of compression are not desired. Alternatively, the natural gas content is selected to only ensure flow back from the reservoir 202 and up the wellbore 201.

This embodiment is useful for flow back of hydraulic fracture treatments containing natural gas where a natural gas pipeline or capture system exists with a high pressure inlet or where sufficient natural gas cannot be added to the fracturing fluid and additional pressurization is required to meet the inlet pressure requirement of the pipeline or processing facility. This embodiment is also applicable where natural gas is directed to a high pressure pipeline or a processing facility where it is desired to reduce the required in-system compression. Further, in those applications where the hydraulic fracturing treatment requirement restricts the natural gas content, this additional pressurization is useful to complete capture of the gaseous well effluent.

In the embodiments shown in FIGS. 5 and 6, a flare (not shown) may be included to initiate and stabilize flow prior to directing recovered gases to the inlet of the pipeline or facilities processing system.

The following examples are provided for illustration only and is not intended to limit the scope of the disclosure or claims.

Example 1

Using an apparatus such as that of FIG. 1, an example proposed application is given to illustrate the method of FIG. 3. The objective is to stimulate a gas bearing reservoir at a depth of 2500 m with a 100 tonnes of proppant using a slick water and natural gas mixture fracturing treatment then capture the well flow back effluent to the pipeline. The well has perforations at a depth of 2510.5 m with 114.3 mm casing, no tubing and a bottom hole temperature of 90° C. In this example, the gas recovered during the well flow back following the treatment is to be directed to a pipeline with an inlet pressure of 1,400 kPa. The pipeline inlet specification for composition is consistent with the injected fracturing mixture gas composition containing 95% methane or better. Overall conditions and requirements of the well for fracturing and flow back are presented in Table 1.

TABLE 1

| Natural Gas Fracturing and Flow Back Example Description | |
|---|---|
| **Well Description** | |
| Reservoir Depth = | 2,500 m |
| Perforations Depth = | 2,510.5 m |
| Reservoir Temperature = | 90° C. |
| Reservoir Pressure = | 17,325 kPa |
| **Wellbore Description** | |
| Tubing/Casing O.D.= | 114.3 mm |
| Wall Thickness = | 9.65 mm |
| Roughness = | 0.0400 mm |
| **Fracturing Conditions** | |
| Bottom Hole Fracturing Pressure = | 45,189 kPa |
| Fracturing Fluid | Slick Water |
| Fracturing Fluid Density | 1,000 kg/m3 |
| **Well Flow Back Conditions** | |
| Bottom Hole Flowing Temperature = | 75° C. |
| Wellhead Flowing Temperature = | 12° C. |
| **Flow Back Requirements - Equipment** | |
| Pipeline Pressure = | 1,400 kPa |
| Surface Equipment Pressure Losses = | 1,000 kPa |
| Target Entry Pressure Above Pipeline = | 200 kPa |
| Minimum Wellhead Flow Pressure = | 2,600 kPa |
| **Flow Back Requirements - Performance** | |
| Maximum Water Flow Rate = | 200 m3/day |
| Target Flow Back Pressure Drawdown = | 60% |
| Bottom Hole Drawdown Pressure = | 6,930 kPa |

The Well Description and Wellbore Description information of Table 1 is extracted from drilling and completion records commonly compiled for wells during their construction. The Fracturing Conditions data is typically acquired from information common to the reservoir and area. Again, Well Flow Back Conditions data are derived from wells in the area, like wells, computer flow simulation studies or general experience. The Flow Back Requirements—Equipment data is based upon the equipment that is to be applied for the flow back operation and knowledge of the operating conditions of the capture pipeline and used to determine the Minimum Wellhead Flow Pressure. In this instance, the Minimum Wellhead Flow Pressure is the sum of the Pipeline Pressure, the Surface Equipment Pressure Losses and the Target Entry Pressure Above Pipeline pressure.

The equipment is specified with the knowledge that the injected fracturing gas composition is sufficient for entry into the pipeline or processing facility without specialized treating. The Flow Back Requirements—Performance are the controllable targets set for the flow back operation. In this example, the Maximum Water Flow Rate is set at 200 m3/day and might be a constraint set by the capacity of the flow back equipment or simply the capacity to transport and dispose recovered water. In some cases a minimum water flow rate may be set in order to ensure flow back of the well is expedited. Alternatively, a gas flow rate constraint might be set based upon capacity or requirements of the pipeline or processing facility. The Target Flow Back Pressure Drawdown is typically based on the draw down needed to effectively mobilize and flow fluids from the reservoir during the fracturing treatment flow back operation. This may be based upon experience, laboratory flow testing of core samples or computer simulation studies. In this case a 60% draw down is selected resulting in a pressure differential between the reservoir and the wellbore of 10,395 kPa at a bottom hole flowing pressure of 6,930 kPa.

As noted above, FIG. 9 is a diagram illustrating the determined bottom hole flow pressures and corresponding natural gas flowing rate from a range of natural gas addition ratios to water for the example well at the specified conditions. A simulator is configured to the example conditions and inputs include the target wellhead flowing pressure of 2,600 kPa with a liquid flowing rate of 200 $m^3$/day. Within these constraints the natural gas ratio is varied and the bottom hole flowing pressure to achieve the target wellhead flowing pressure is determined. Examination of the diagram shows bottom hole pressures as high as 27,200 kPa when no gas is added to as low as 5,025 kPa with gas added at 500 $sm^3/m^3$ water. For the example well with no gas addition, the bottom hole fluid pressure far exceeds the reservoir pressure and flow back without gas lift or swabbing cannot be expected. A natural gas ratio of at least 55 $sm^3/m^3$ water is needed just to balance the flowing pressures and the reservoir pressure. The effect of flowing frictional pressure losses is seen with the asymptotic behavior of the bottom hole pressure with increasing natural gas addition at a constant liquid flow rate; as the natural gas content is increased, the friction pressure increases reducing the effectiveness of the commingled fluid density reduction achieved by adding the natural gas. To achieve the target bottom hole flowing pressure of 6,930 kPa under these conditions, a Natural Gas to Water Ratio of approximately 250 $sm^3/m^3$ is required. The wellhead flowing pressure is estimated at 2,600 kPa with a liquid rate of 200 $m^3$/day, a gas rate of 50,000 $sm^3$/day at a bottom hole flow pressure of 6,930 kPa and meets the target flow back performance requirements.

Figure 10:
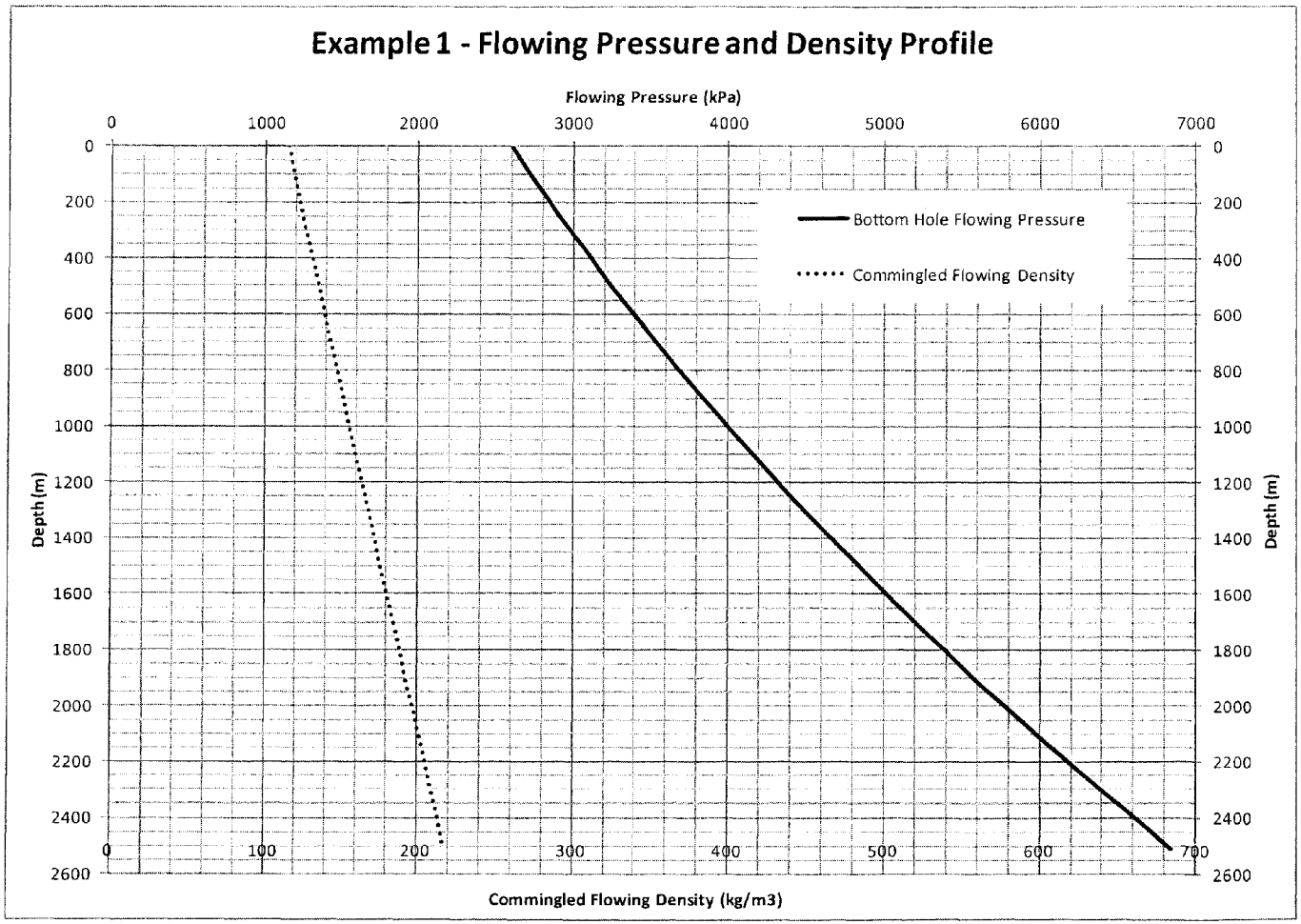
FIG. 10 is a diagram illustrating the pressure and density profile within an example wellbore at a chosen natural gas addition ratio.

FIG. 10 is a diagram illustrating the pressure and density profile within the example wellbore at the Natural Gas to Water Ratio of 250 $sm^3/m^3$ where the vertical axis is the depth within the wellbore, the top horizontal axis the flowing pressure at depth within the wellbore and the lower horizontal axis the density of the flowing commingled natural gas and water within the wellbore at depth. The commingled fluid density ranges from 115 $kg/m^3$ at surface to 218 $kg/m^3$ at bottom hole conditions implying a hydrostatic pressure of approximately 4,100 kPa. The differences between pressure that would result from the commingled fluid density and the density profile are those resulting from flowing frictional losses determined in this instance at about 230 kPa. The flowing pressure profile plot at the Natural Gas to Water Ratio of 250 $sm^3/m^3$ shows the target bottom hole flowing pressure of 6,930 kPa at the depth of 2510.5 m and the target wellhead flowing pressure of 2,600 kPa. In this manner, the minimum natural gas content of the flow back stream has been selected.

The selected natural gas content is then applied to the hydraulic fracturing treatment design resulting in the fracturing injection schedule of Table 2. The design of the hydraulic fracture treatment may be completed based upon known performance and requirements for the reservoir or may be based upon a formal engineering design utilizing a hydraulic fracture simulator. The resulting treatment places 100 tonnes of proppant utilizing 128 $m^3$ of water with 31,990 $m^3$ of natural gas to create a total fracturing fluid volume of 230 $m^3$. This reduces the water placed into the formation by almost 45% and with that significantly reduces the surface water handling capacity, time and requirement. In this instance the fracturing schedule specifies natural gas is added to the fracturing fluid at the selected ratio of 250 $sm^3$ of natural gas per $m^3$ of water. In applying the selected natural gas ratio to the fracturing treatment it is presumed that the reservoir is known to contain only dry natural gas without native liquids; water or condensates. Should the reservoir be known to potentially contain or produce native liquids, the natural gas added ratio could be increased to ensure a sufficient wellhead flowing pressure exists with these additional liquids in the flow back stream. A flow back sensitivity investigation around additional native liquids flow can be applied to determine the optimum natural gas added increase, if required. Alternatively, reservoirs can contribute native natural gas to the flow back further enhancing flow back performance. In that case, less than the selected minimum amount of natural gas may suffice for a given reservoir. Though not illustrated in this example, the applied natural gas content can also be varied throughout the fracturing treatment as required to best meet the fracture treatment or flow back requirements. For instance, a pre-pad volume containing only natural gas may be injected, or a proppant stage or stages without natural gas may be applied.

TABLE 2

| Natural Gas and Slick Water Fracturing Treatment Program | | | | | |
|---|---|---|---|---|---|
| NATURAL GAS WITH SLICK WATER FRACTURE TREATMENT | | | | | |
| Depth = | 2510.5 m | FG = | 18 kPa/m | Tubing = | 114.3 mm |
| Rate = | 5.0 m3/min | | | Capacity = | 0.007417 m3/m |
| WHIP = | 48.4 MPa | | | | |

TABLE 2-continued

Natural Gas and Slick Water Fracturing Treatment Program

| | | | | |
|---|---|---|---|---|
| Proppant tonne | 100.0 20/40 mesh sand | Hole Volume | 18.62 m3 |
| | | Underflush | 0.5 m3 |
| Proppant Total | 100.0 tonne | Bottom Hole Fracturing Pressure = | 45.19 MPa |
| Proppant Density | 2650 kg/m3 | | |
| Total Rate | 5.0 m3/min | Bottom Hole Temperature = | 90 deg C. |
| Water Rate | 2.8 m3/min | Natural Gas Vol Factor = | 312.33 sm3/m3 space |
| NG Rate | 695 sm3/min | Natural Gas to Water Ratio = | 250 sm3/m3 water |
| Gas Factor | 45% | | |

| | | Slick Water | | | Proppant | | |
|---|---|---|---|---|---|---|---|
| Stage Description | Slurry Blender Rate (m3/min) | Slick Water Rate (m3/min) | Slick Water Volume (m3) | Cumulative Slick Water Volume (m3) | Blender Concentration (kgSA/m3 liq) | Proppant Stage (tonne) | Cumulative Proppant (tonne) |
| Fill Hole | 0.50 | 0.5 | 10.3 | | | | |
| Pad | 2.78 | 2.78 | 14.0 | 24.3 | | | |
| Start 20/40 sand | 2.78 | 2.41 | 15.0 | 39.3 | 720 | 10.8 | 10.8 |
| Increase concentration | 2.78 | 2.31 | 20.0 | 59.3 | 960 | 19.2 | 30.0 |
| Increase concentration | 2.78 | 2.22 | 25.0 | 84.3 | 1200 | 30.0 | 60.0 |
| Increase concentration | 2.78 | 2.22 | 33.4 | 117.7 | 1200 | 40.0 | 100.0 |
| Flush treatment | 2.78 | 2.78 | 10.1 | 127.7 | | | |

| | Natural Gas | | | Downhole Conditions | | |
|---|---|---|---|---|---|---|
| Stage Description | Nat'l Gas Rate (sm3/min) | Nat'l Gas Stage Volume (m3) | Cumulative Nat'l Gas (sm3) | Total Rate (m3/min) | Conc @ Perfs (kgSA/m3) | Gas Fraction (–) |
| Fill Hole | 125 | 2588 | 2588 | 0.90 | | 0.445 |
| Pad | 695 | 3506 | 6094 | 5.00 | 0 | 0.445 |
| Start 20/40 sand | 604 | 3756 | 9850 | 5.00 | 400 | 0.445 |
| Increase concentration | 579 | 5009 | 14859 | 5.00 | 533 | 0.445 |
| Increase concentration | 555 | 6261 | 21119 | 5.00 | 666 | 0.445 |
| Increase concentration | 555 | 8352 | 29471 | 5.00 | 666 | 0.445 |
| Flush treatment | 695 | 2518 | 31990 | 5.00 | 0 | 0.445 |

Volume Requirement

| | Treatment | | Bottoms | Total Fluid |
|---|---|---|---|---|
| Natural Gas | 31,990 sm3 | 53.3 m3 liq | 5 m3 | 58.3 m3 |
| Slick Water | | 127.7 m3 | 15 m3 | 142.7 m3 |

With a fracturing treatment program developed to meet the application needs, the equipment and required materials are mobilized to the well site for completion of the fracturing treatment and flow back operations using natural gas and slick water. The equipment is spotted and rigged in to complete the fracturing treatment and materials loaded. In this example, a LNG based natural gas source and preparation is applied; however any natural gas source and preparation method may be used. Similarly, the well servicing preparing and pressurizing equipment shown is that of common blender and fracturing fluid pumpers, though any suitable configuration can be applied to prepare and pressure the liquid based well servicing stream. Upon rigging and loading the equipment, the pre-treatment preparation requirements for fracturing with a natural gas and liquid mixture are completed which may include a hazards orientation, pressure test, safety meetings and detailed treatment requirement discussions. Upon completing all pre-treatment requirements, fracture pumping operations are begun according to the example Natural Gas and Slick Water Fracturing Treatment Program of Table 2. The liquid, proppant and chemicals are mixed and pressured with the equipment apparatus like that displayed in FIG. 1, items 4 while the natural gas is pressured and prepared with the equipment apparatus like that of items 22. These prepared streams are then commingled at the mixer 30 and injected into the well as a natural gas and water mixture which may or may not contain fluid modifying chemicals or proppants. The mixture then travels down the wellbore 201 of FIG. 2*a* and into the reservoir 202 to create the underground fractures 203. Upon pumping the hydraulic fracture treatment either as specified by Table 2, or as adapted to meet the well response during the fracturing treatment, injection is stopped and the surface equipment secured.

At a time deemed suitable for the well being fractured, flow from the well is initiated to remove the injected fracturing fluids in order to bring the well on production. Pressure at the wellhead 32 is released to the flow back apparatus items 3 FIG. 1 to induce flow within the wellbore 201 FIG. 2*b*, the created fractures 203 and the invaded zone fluids 207 of injected fracturing liquid, injected natural gas and native reservoir fluids. The resulting well stream flow at surface is directed through the choke 5 to the phase separator 36 where gases, liquids and solids can be separated. Produced solids may include the fracturing proppant and accumulate within the separator vessel 36 and removed as needed for space considerations. Injected and native liquids are accumulated within the separator 36 and drained into a storage vessel 38. Injected and reservoir based natural gas are directed from the separator vessel 36 to the gas pipeline 40 for capture and resale. Optionally, though not preferentially, flare 42 may be utilized to initiate flow prior to directing natural gas to the pipeline. This may be necessary to stabilize the flow while adjusting the choke to achieve the correct flowing inlet pressure through the surface equipment and into the pipeline. As illustrated in this example, with natural gas injection as part of the fracturing fluid at a sufficient ratio and composition, directing the natural gas to the pipeline or processing facility at sufficient pressure is accomplished and fracture clean-up without the need to vent or flare, or with substantial reductions of venting or flaring, can be achieved. Natural gas within the fracturing fluid permits capture and sale of injected and native reservoir natural gas.

Volume replacement of liquids for hydraulic fracturing is also highly beneficial to minimize recovery liquids handling requirements, reduce flow back time and for improved well performance. In this example, a water reduction of 45% is accomplished by placing a fracture fluid volume of 230 $m^3$ while only utilizing 128 $m^3$ of water. In this example, presuming complete water recovery, a liquid flow back rate of 200 $m^3$/day is anticipated such that the fracturing liquid can be recovered in less than 24 hours. Without added natural gas, the reservoir pressure is seen to be insufficient to flow back water without an assist such as swabbing or gas-lift. These assisting techniques will take time to deploy and result in flow back times that may extend to days rather than hours. This will increase the cost and complexity of the flow back operation. Additionally, with less water placed into the reservoir itself, improved flow performance is expected. Less water in the reservoir results in less water removal needed to achieve a given production target.

Example 2

Consider for example replacement of a hydraulic fracture treatment on a well requiring a slick water fracturing treatment to 3,000 $m^3$. For the slick water fracturing treatment the water is collected for injection in an open pit replacing the otherwise required 40 water storage tanks. Following injection and fracture closure, flow back operations begin where it is presumed the flowing pressure is just sufficient to permit flow at back pressure near atmospheric. With expectation for normal post-treatment liquid recovery, approximately 35% of the injected water would be recovered to a volume of just over 1,000 $m^3$. With the near atmospheric surface flowing pressure, insufficient flowing pressure exists to direct flow through a separator and all flow is necessarily directed by piping to an open pit. The water is collected into the pit while gases are vented to atmosphere or when possible ignited over the pit. At a presumed maximum attainable recovery rate of 100 $m^3$/day, flow back is completed over an estimated 10 day period. When flow back is deemed complete the 1,000 $m^3$ of recovered water, contaminated with fracturing chemicals and dissolved formation products, is withdrawn from the pit and disposed, or preferentially treated to allow use in a subsequent fracturing operation. Applying natural gas to a hydrocarbon based well servicing fluid in replacement of the slick water can improve the flow back operation as follows: First, presuming a selected gas added ratio to the hydrocarbon based fracturing fluid at 450 $sm^3/m^3$ hydrocarbon liquid, a 3,000 m3 fracture volume requires only 1,430 $m^3$ of hydrocarbon fracturing liquid with the remaining 1,570 $m^3$ comprised of natural gas. The liquid is collected and stored in approximately 18 liquid storage tanks in preparation for the treatment. Following injection and fracture closure, the natural gas hydrocarbon mixture will exhibit a reduced flow back density in the order of 325 $kg/m^3$ such that the flow back pressure at surface will be in excess of 5,000 kPa. With a normal expectation for liquids recovery from an energized hydrocarbon fracturing treatment, approximately 75% of the injected oil would be recovered to a volume of approximately 1,000 $m^3$. With sufficient surface flowing pressure, the flow back can be directed through a phase separator and the natural gas stream diverted to any available pipeline or processing facility. With additional flowing pressure available, the liquid recovery rate can be increased to a presumed 200 $m^3$/day and the flow back completed over a 5 day period. The hydrocarbon fracturing liquid recovered in the phase separator is directed to the recovery tanks for handling towards processing for sale or re-use. In this or a similar manner, by creating and injecting a selected hydrocarbon fracturing base liquid containing a selected natural gas composition and content, a waterless and environmentally closed fracturing system can be created and applied.

The invention claimed is:

1. A method for hydraulically fracturing a formation in a reservoir using a fracturing fluid mixture comprising natural gas and a fracturing base fluid and for recovering after the fracturing, a well stream from a well fluidly coupled to the reservoir and to a surface processing facility, the method comprising:

(a) defining flow back requirements for flowing the well stream from the well and into the processing facility;

(b) determining a natural gas composition of the fracturing fluid mixture from the determined flow back requirements that results in a composition of a gas component of the well stream that is compatible with gas composition requirements of the processing facility;

(c) determining a natural gas content of the fracturing fluid mixture from the determined flow back requirements that results in a wellhead flowing pressure sufficient to flow the well stream at least to surface;

(d) forming the fracturing fluid mixture having the determined natural gas composition and content;

(e) during a formation fracturing stage, injecting the fracturing fluid mixture into the well to fracture the formation; and (f) during a flow back stage, flowing the gas component of the well stream from the well into the processing facility, wherein at least some of the well stream includes the injected natural gas in the fracturing fluid mixture.

2. A method as claimed in claim 1 wherein in step (c) the natural gas content is determined which also results in a well stream pressure at a capture system inlet that at least meets inlet pressure requirements of the processing facility.

3. A method as claimed in claim 2 wherein the well stream includes native reservoir gases, and at least some of the native reservoir gases and injected natural gases are flowed into the processing facility.

4. A method as claimed in claim 2 wherein the well stream includes native reservoir liquids and the method further comprises separating a liquid component comprising the native reservoir liquids from the well stream using flow back equipment fluidly coupled between the well and the processing facility.

5. A method as claimed in claim 2 wherein the flow back requirements include pressure losses associated with flow back equipment fluidly coupled between the well and the processing facility.

6. A method as claimed in claim 5 wherein the processing facility is configured to process gases and liquids, and the method further comprises in step (b): determining a natural gas composition of the fracturing fluid mixture from the determined flow back requirements that results in a composition of a gas component and a liquid component of the well stream that are compatible with gas and liquid composition requirements of the processing facility; and in step (f): during a flow back stage, flowing the gas and liquid components of the well stream from the well into the processing facility, wherein at least some of the well stream includes the injected natural gas in the fracturing fluid mixture.

7. A method as claimed in claim 6 wherein the flow back equipment comprises a solids separator and the method further comprises separating solids from the well stream using the solids separator prior to flowing the gas and liquid components to the processing facility.

8. A method as claimed in claim 5 wherein the flow back equipment comprises a gas-liquid flow separator, and the method further comprises: separating a gas component from the flow back fluids using the gas-liquid flow separator and then flowing the gas component to the processing facility.

9. A method as claimed in claim 5 wherein the flow back equipment includes a three-phase separator and the method further comprises using the three-phase separator to separate a gas component, a water component, and an oil component from the well stream.

10. A method as claimed in claim 9 further comprising flowing the separated gas component to the processing facility, flowing the water component to a water treatment or a disposal facility or to a water storage tank, and flowing the oil component to an oil processing facility, a sales facility, or an oil storage tank.

11. A method as claimed in claim 1 further comprising separating a gas component from the well stream using flow back equipment fluidly coupled between the well and the processing facility, and compressing the gas component using a compressor of the flow back equipment to a pressure that at least meets inlet pressure requirements of the processing facility.

12. A method as claimed in claim 11 further comprising after separation of the gas component and before compression, recovering condensing water from the separated gas component using the flow back equipment until the gas component meets inlet requirements of the compressor.

13. A method as claimed in claim 12 wherein the flow back equipment further comprises a natural gas liquids recovery or scrubbing unit and the method further comprises after separation of the gas component and before compression, using the natural gas recovery or scrubbing unit to remove condensing liquids from the gas component until the gas component meets inlet requirements of the compressor.

14. A method as claimed in claim 1 wherein the fracturing base fluid is an aqueous fluid.

15. A method as claimed in claim 1 wherein the fracturing base fluid is a hydrocarbon based fluid.

16. A method as claimed in claim 1 wherein the flow back requirements include a maximum fracturing base fluid flow rate that results in a recovered fracturing base fluid volume that is within specifications of a water storage tank and the method further comprises separating water from the well stream using surface flow back equipment fluidly coupled between the well and the processing facility, and storing the water in the water storage tank.

17. A method as claimed in claim 1 wherein during the flow back stage, the gas component of the well stream is flowed from the well into the processing facility without venting or flaring.

18. A method for hydraulically fracturing a formation in a reservoir using a fracturing fluid mixture comprising natural gas and a base fluid and for recovering after the fracturing, a well stream from a well fluidly coupled to the reservoir and to a surface processing facility, the method comprising:

(a) defining flow back requirements for flowing the well stream from the well and into the processing facility;

(b) determining a natural gas content of the fracturing fluid mixture from the determined flow back requirements that results in a surface flowing pressure sufficient to flow the well stream to surface and which meets inlet pressure requirements of the processing facility;

(c) forming the fracturing fluid mixture having the selected natural gas content;

(d) during a formation fracturing stage, injecting the fracturing fluid mixture into the well to fracture the formation; and (e) during a flow back stage, flowing at least a gas component of the well stream from the well into the processing facility, wherein at least some of the well stream includes the injected natural gas in the fracturing fluid mixture.

19. A method as claimed in claim 18 further comprising determining a natural gas composition of the fracturing fluid mixture from the determined flow back requirements that results in a composition of the gas component of the well stream that is compatible with gas composition requirements of the processing facility.

20. A method as claimed in claim 18 further comprising processing the gas component of the well stream using surface flow back equipment fluidly coupled between the well and the processing facility until the composition of the gas component meets gas composition requirements of the processing facility.

* * * * *